US011476608B2

(12) United States Patent
Lin et al.

(10) Patent No.: US 11,476,608 B2
(45) Date of Patent: Oct. 18, 2022

(54) ELECTRICAL CONNECTOR WITH POWER TERMINALS SURROUNDING THE SIGNAL TERMINALS

(71) Applicant: Cheng Uei Precision Industry Co., LTD., New Taipei (TW)

(72) Inventors: Chun-Fu Lin, New Taipei (TW); Sheng-Nan Yu, New Taipei (TW); Chih-Chiang Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 15 days.

(21) Appl. No.: 17/342,520

(22) Filed: Jun. 8, 2021

(65) Prior Publication Data

US 2022/0131297 A1 Apr. 28, 2022

(30) Foreign Application Priority Data

Oct. 23, 2020 (CN) ..... 202022397430.5

(51) Int. Cl.

| | |
|---|---|
| ***H01R 13/6471*** | (2011.01) |
| ***H01R 24/40*** | (2011.01) |
| ***H01R 13/11*** | (2006.01) |
| *H01R 13/52* | (2006.01) |

(52) U.S. Cl.

CPC ..... *H01R 13/112* (2013.01); *H01R 13/5202* (2013.01); *H01R 13/6471* (2013.01); *H01R 24/40* (2013.01)

(58) Field of Classification Search

CPC ..... H01R 13/112; H01R 13/11; H01R 43/16; Y10T 29/49204

See application file for complete search history.

(56) References Cited

U.S. PATENT DOCUMENTS

| | | | | |
|---|---|---|---|---|
| 6,464,542 | B1 * | 10/2002 | Lee | H01R 12/716 439/924.1 |
| 6,780,027 | B2 * | 8/2004 | Allison | H01R 12/727 439/907 |
| 7,473,110 | B1 * | 1/2009 | Wu | H01R 13/41 439/79 |
| 7,682,161 | B2 * | 3/2010 | Mao | H01R 12/7088 439/74 |
| 8,905,790 | B2 * | 12/2014 | Staudigel | H01R 13/50 439/607.05 |
| 10,627,090 | B2 * | 4/2020 | Mostoller | F21V 23/0464 |

(Continued)

*Primary Examiner* — Vanessa Girardi
(74) *Attorney, Agent, or Firm* — Cheng-Ju Chiang

(57) ABSTRACT

An electrical connector includes an insulating body, a plurality of signal terminals assembled to the insulating body, and a plurality of power terminals assembled to the insulating body. The plurality of the power terminals surround and are spaced from the plurality of the signal terminals. Each power terminal has a base plate. Two opposite sides of the base plate extend towards the plurality of the signal terminals to form two bending arms. Two free ends of the two bending arms extend towards each other to form two connecting portions. A middle of a rear end of the base plate slantwise extends inward and towards the docking connector to form one first elastic arm. Two rear ends of the two connecting portions slantwise extend inward and towards the docking connector to form two second elastic arms.

20 Claims, 16 Drawing Sheets

(56) References Cited

U.S. PATENT DOCUMENTS

| | | | | |
|---|---|---|---|---|
| 10,714,854 | B2 * | 7/2020 | Peng | H01R 13/187 |
| 11,128,077 | B1 * | 9/2021 | Lai | H01R 13/111 |
| 2005/0112952 | A1 * | 5/2005 | Wang | H01R 12/716 439/660 |
| 2022/0131308 | A1 * | 4/2022 | Lin | H01R 31/06 |

* cited by examiner

ELECTRICAL CONNECTOR WITH POWER TERMINALS SURROUNDING THE SIGNAL TERMINALS

CROSS-REFERENCE TO RELATED APPLICATION

The present application is based on, and claims priority from, China Patent Application No. 202022397430.5, filed Oct. 23, 2020, the disclosure of which is hereby incorporated by reference herein in its entirety.

BACKGROUND OF THE INVENTION

1. Field of the Invention

The present invention generally relates to an electrical connector, and more particularly to a vehicle-used electrical connector and a terminal of the electrical connector.

2. The Related Art

Generally, a conventional electrical connector includes an insulating housing, and a plurality of terminals assembled to the insulating housing. The insulating housing has a columnar section, and an annular receiving groove surrounding the columnar section. The columnar section has a mating face, a plurality of lengthwise power terminal passageways and a plurality of signal terminal passageways penetrating through the mating face. The plurality of the signal terminal passageways are shown as pinhole shapes. The signal terminal passageways are located to two sides of the plurality of the power terminal passageways. The plurality of the terminals include a plurality of power terminals received in the plurality of the power terminal passageways, and a plurality of signal terminals received in the plurality of the signal terminal passageways.

However, the above-mentioned power terminals of the conventional electrical connector are made by two terminal pieces which are opposite to each other. Thus, the conventional electrical connector described above has a higher manufacture cost and a worse current transmission stability.

Thus, it is essential to provide an innovative electrical connector and an innovative terminal of the innovative electrical connector, the innovative electrical connector including the innovative terminal is integrally formed, and the innovative electrical connector including the innovative terminal has a lower manufacture cost and increases a current transmission stability to have a better current transmission stability.

SUMMARY OF THE INVENTION

An object of the present invention is to provide an electrical connector adapted for being docked with a docking connector. The electrical connector includes an insulating body, a plurality of signal terminals assembled to the insulating body, and a plurality of power terminals assembled to the insulating body. The plurality of the power terminals surround and are spaced from the plurality of the signal terminals. Each power terminal has a base plate. Two opposite sides of the base plate extend towards the plurality of the signal terminals to form two bending arms. Two free ends of the two bending arms extend towards each other to form two connecting portions. A middle of a rear end of the base plate slantwise extends inward and towards the docking connector to form one first elastic arm. Two rear ends of the two connecting portions slantwise extend inward and towards the docking connector to form two second elastic arms. The one first elastic arm slantwise extends towards the two second elastic arms slightly. The one first elastic arm is disposed corresponding to an interval between the two second elastic arms. A rear end of the one first elastic arm extends towards the docking connector and then is arched inward and towards the interval between the two second elastic arms to form a first bending portion. An inner portion of the first bending portion is defined as a first protruding portion. Two rear ends of the two second elastic arms extend towards the docking connector and then are arched inward and approach to two sides of the one first elastic arm to form two second bending portions. An inner portion of each second bending portion has a second protruding portion. The first protruding portion of the one first elastic arm and the two second protruding portions of the two second elastic arms are arched in opposite directions and along a vertical direction. The first protruding portions and the second protruding portions of the plurality of the power terminals are aligned along a vertical plane.

Another object of the present invention is to provide an electrical connector adapted for being docked with a docking connector. The electrical connector includes an insulating body, a plurality of signal terminals assembled to the insulating body, and a plurality of power terminals mounted in the insulating body. The plurality of the power terminals surround and are spaced from the plurality of the signal terminals. Each power terminal has a base plate, two first elastic arms and two second elastic arms. Two opposite sides of the base plate extend towards the plurality of the signal terminals to form two bending arms. Two free ends of the two bending arms extend towards each other to form two connecting portions. Two sides of a rear end of the base plate slantwise extend inward and towards the docking connector to form one first elastic arm and one second elastic arm. Two rear ends of the two connecting portions slantwise extend inward and towards the docking connector to form the other first elastic arm and the other second elastic arm. The one first elastic arm and the one second elastic arm of the base plate are corresponding to and are complementary to the other second elastic arm and the other first elastic arm of the two connecting portions. The one first elastic arm and the one second elastic arm of the base plate slantwise extend towards the other second elastic arm and the other first elastic arm of the two connecting portions, and the other first elastic arm and the other second elastic arm of the two connecting portions slantwise extend towards the one second elastic arm and the one first elastic arm of the base plate from fronts of the plurality of the power terminals to rears of the plurality of the power terminals gradually.

Another object of the present invention is to provide an electrical connector adapted for being docked with a docking connector. The electrical connector includes an insulating body, a plurality of signal terminals assembled to the insulating body, and a plurality of power terminals mounted in the insulating body. The plurality of the power terminals surround and are spaced from the plurality of the signal terminals. Each power terminal has a base plate, two first elastic arms and two second elastic arms. Two opposite sides of the base plate extend towards the plurality of the signal terminals to form two bending arms. Two free ends of the two bending arms extend towards each other to form two connecting portions. Two sides of a rear end of the base plate slantwise extend inward and towards the docking connector to form one first elastic arm and one second elastic arm. Two rear ends of the two connecting portions slantwise extend inward and towards the docking connector to form the other first elastic arm and the other second elastic arm. The one first elastic arm and the one second elastic arm of the base plate slantwise extend towards the other second elastic arm and the other first elastic arm of the two connecting portions, and the other first elastic arm and the other second elastic arm of the two connecting portions slantwise extend towards the one second elastic arm and the one first elastic arm of the base plate from fronts of the plurality of the power terminals to rears of the plurality of the power terminals gradually.

As described above, each power terminal has a shielding function for isolating an external signal interference to prevent each signal terminal from being interfered. When the docking connector is docked with the electrical connector, a plurality of conductive terminals are corresponding to the plurality of the signal terminals, a plurality of docking terminals are corresponding to the plurality of the power terminals. The first elastic arms and the second elastic arms of the connecting portions of the plurality of the power terminals are corresponding and complementary to the first elastic arms and the second elastic arms of the base plates of the plurality of the power terminals, so that an insertion force of the plurality of the docking terminals being inserted into the plurality of the power terminals is reduced to prevent the plurality of the docking terminals and the plurality of the power terminals from being deformed at the time of the plurality of the docking terminals being inserted into the plurality of the power terminals. As a result, the electrical connector including the plurality of the power terminals and the signal terminals has a lower manufacture cost and increases a current transmission stability to have the better current transmission stability.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
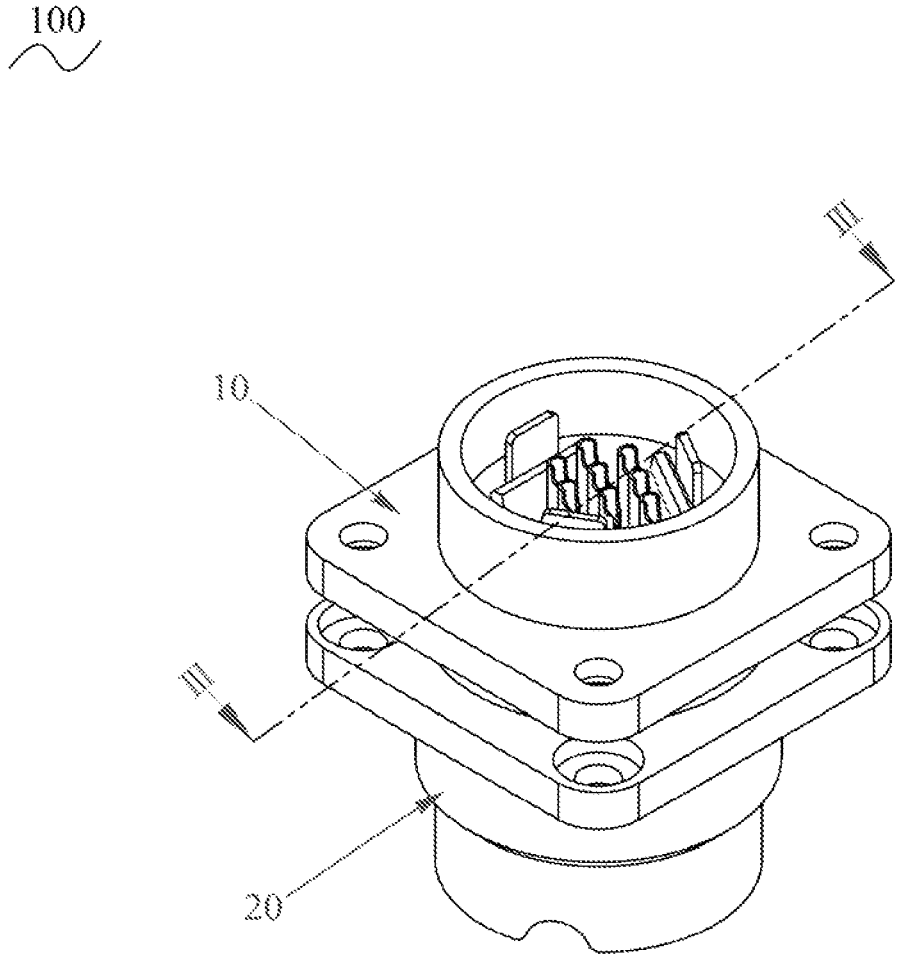
FIG. 1 is a perspective view of an electrical connector assembly in accordance with the present invention, wherein the electrical connector assembly includes an electrical connector, and a docking connector docked with the electrical connector.
Figure 2:
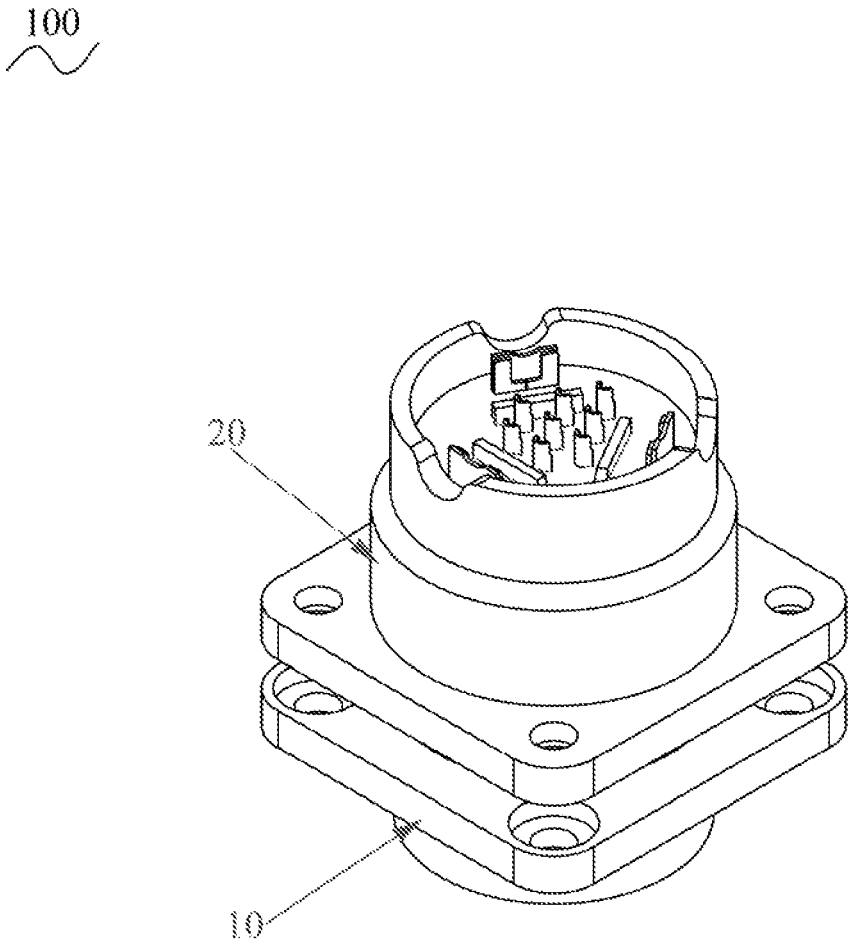
FIG. 2 is another perspective view of the electrical connector assembly of FIG. 1.
Figure 3:
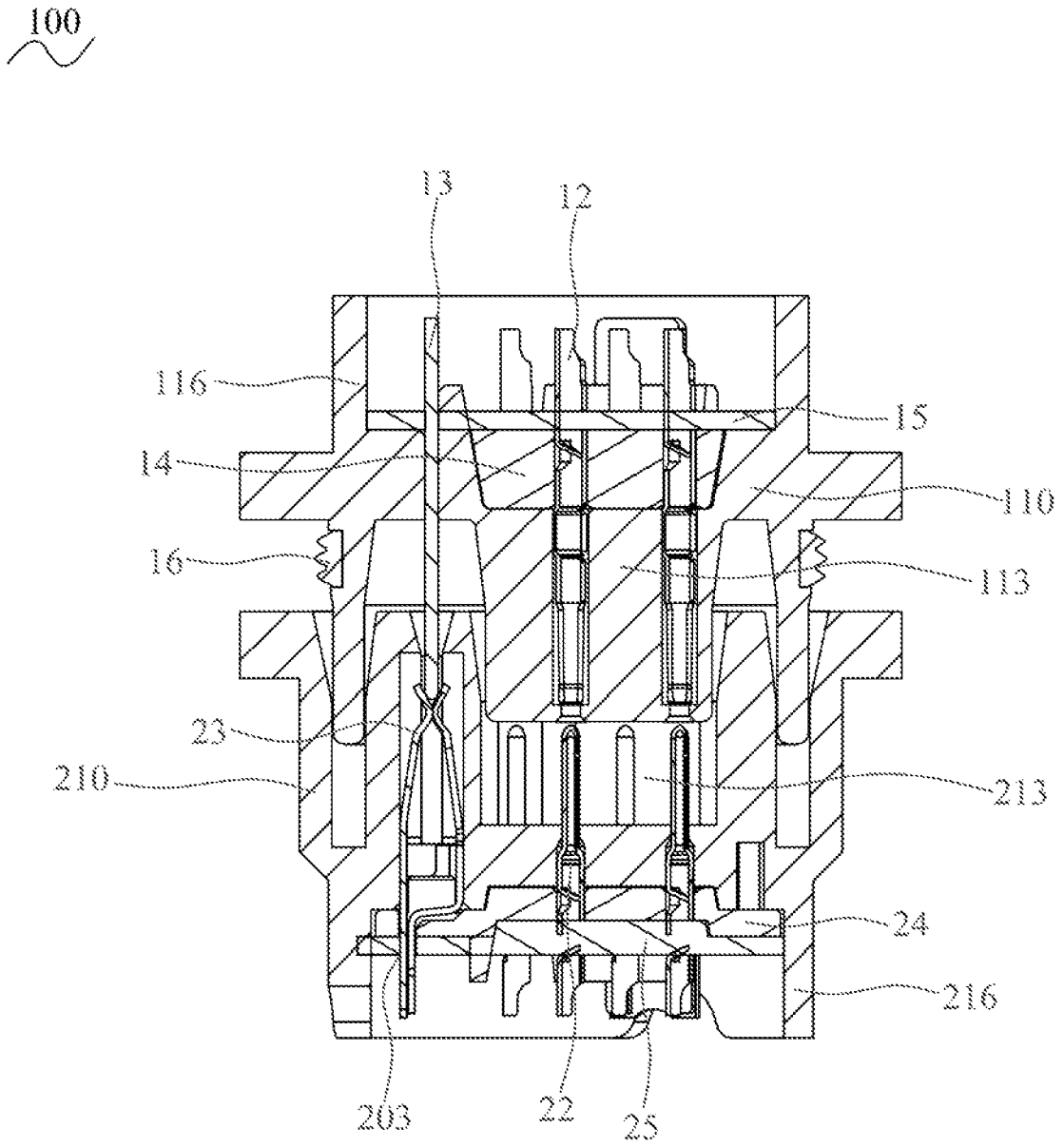
FIG. 3 is a sectional view of the electrical connector assembly along a line III-III of FIG. 1.
Figure 4:
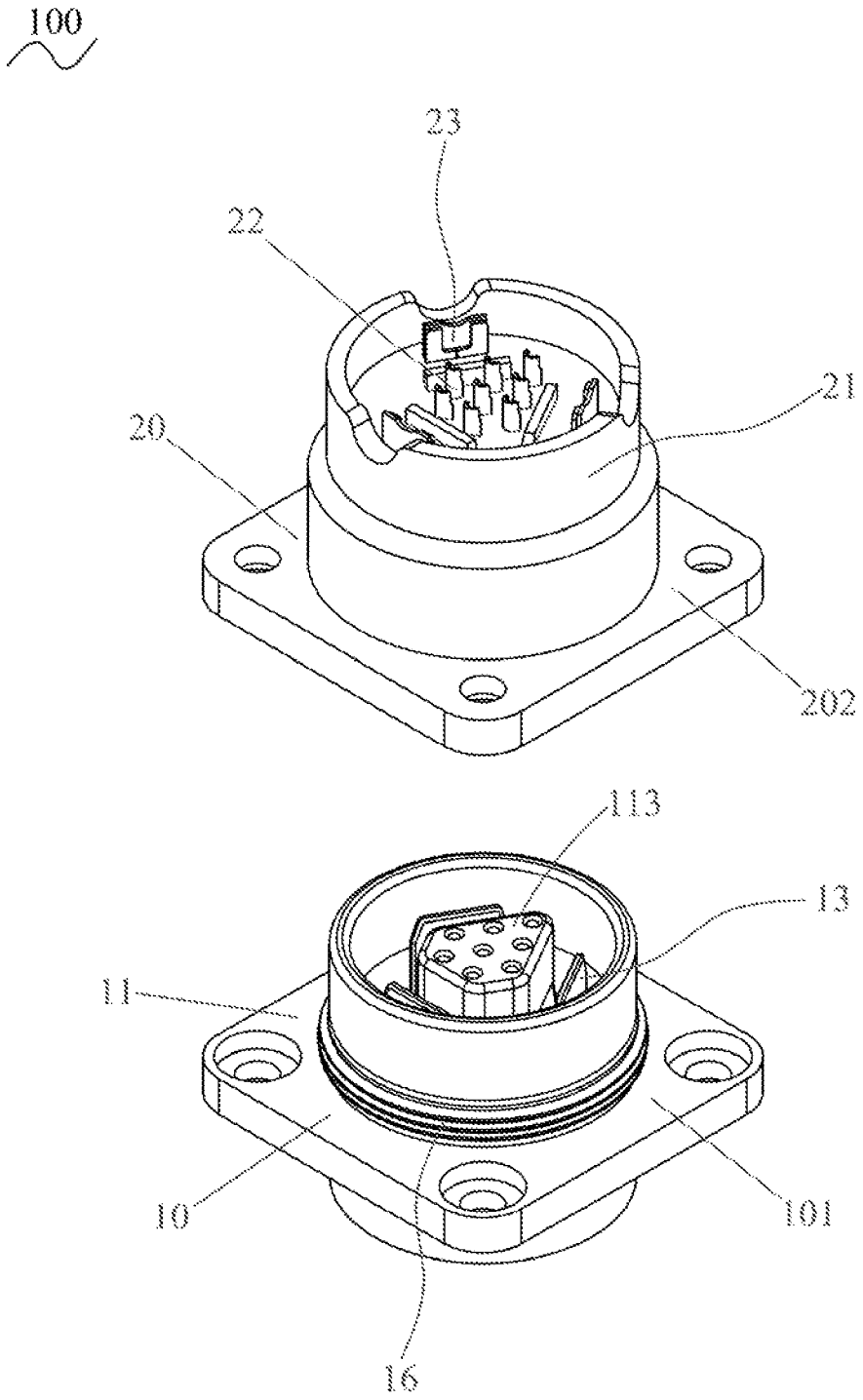
FIG. 4 is an exploded view of the electrical connector assembly of FIG. 1.
Figure 5:
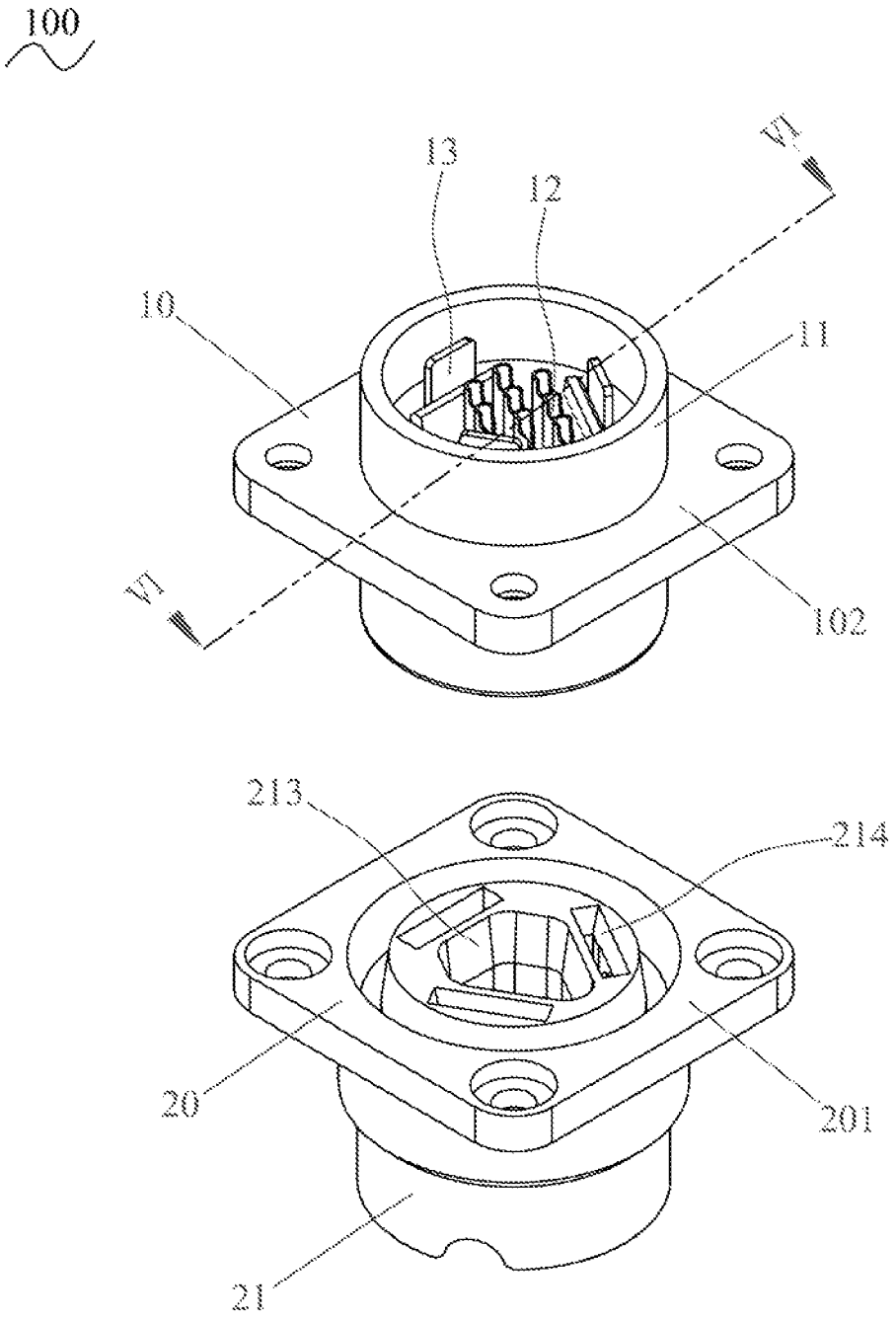
FIG. 5 is another exploded view of the electrical connector assembly of FIG. 1.
Figure 6:
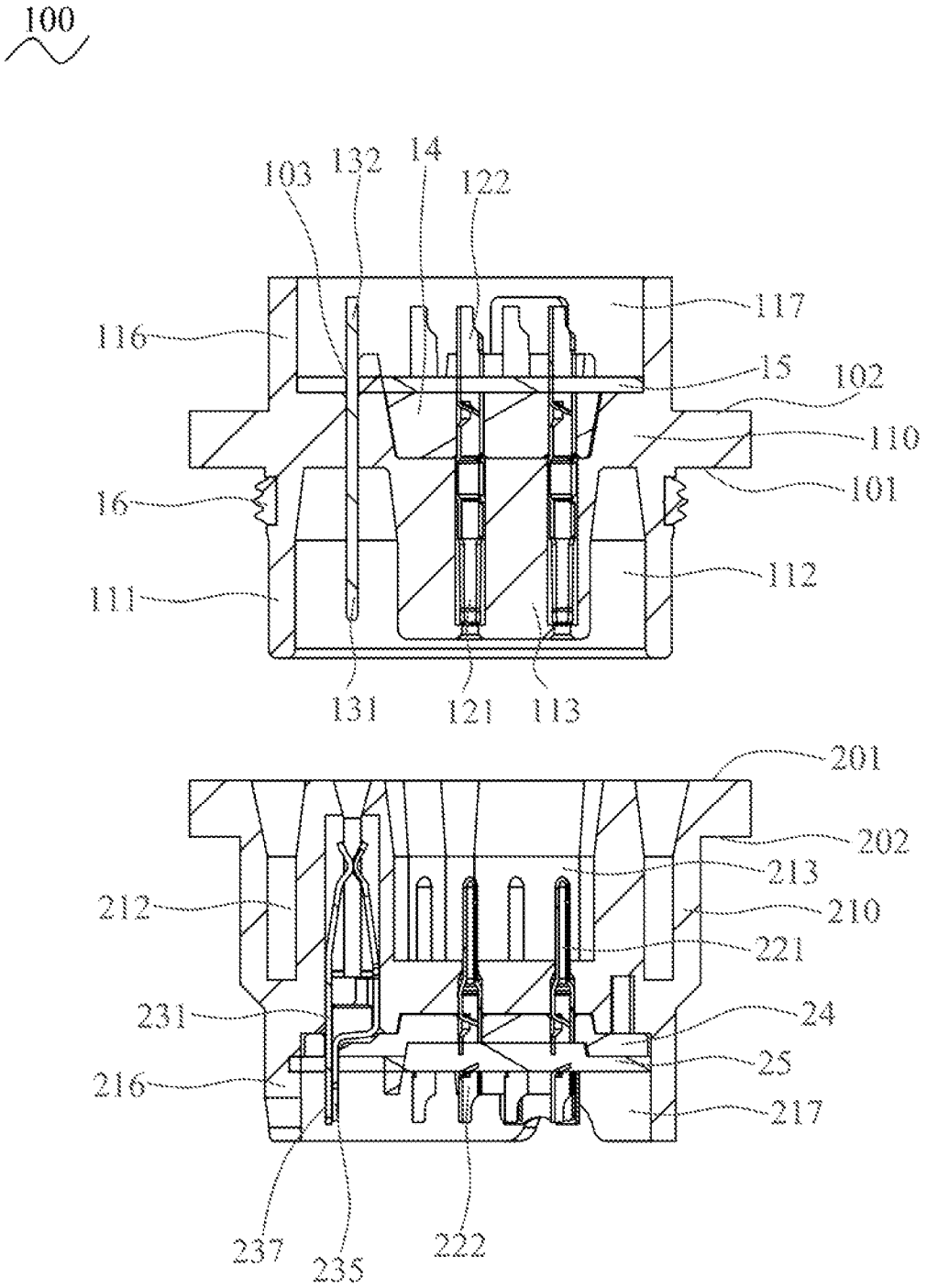
FIG. 6 is a sectional view of the electrical connector assembly along a line VI-VI of FIG. 5.
Figure 7:
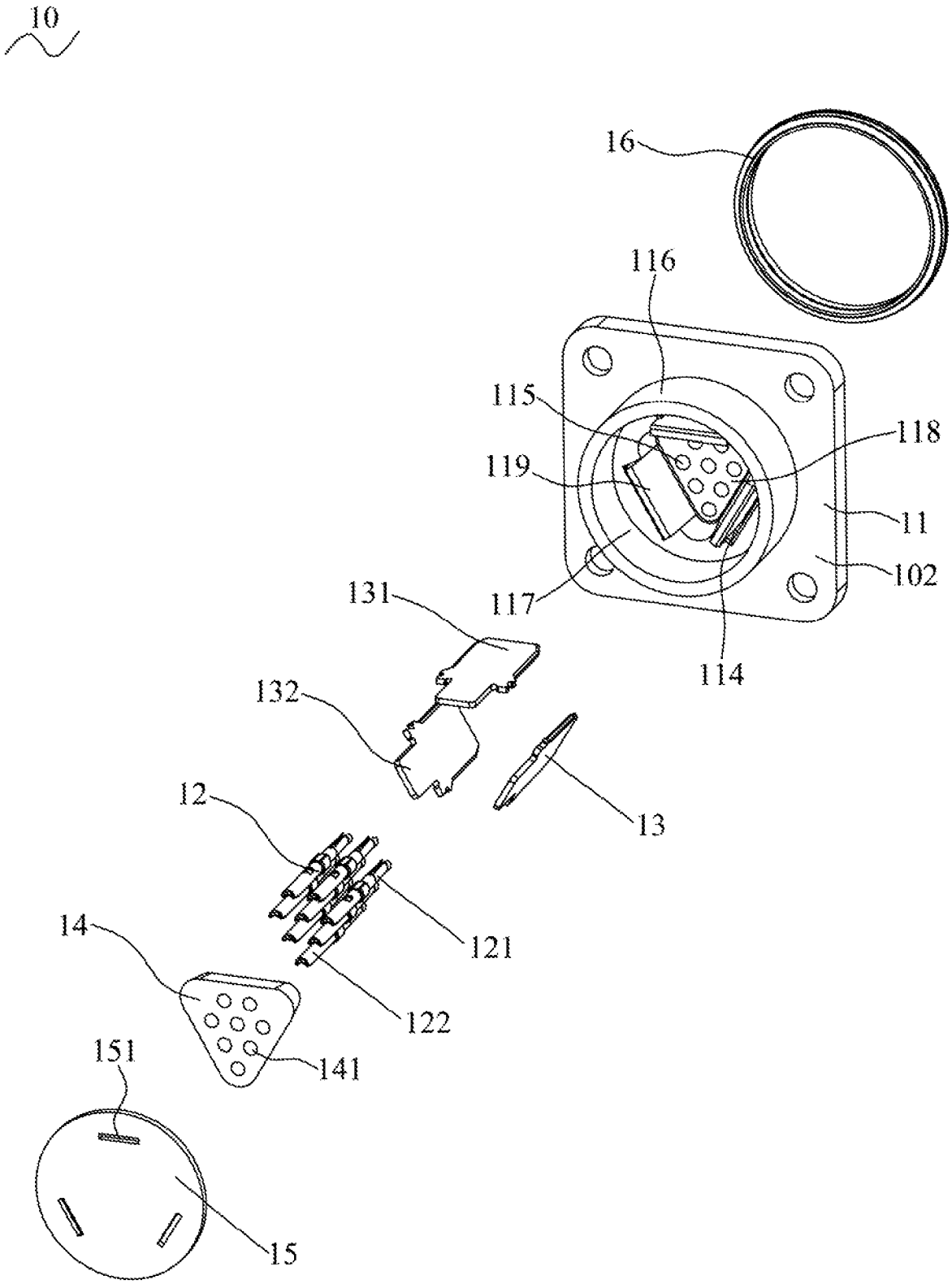
FIG. 7 is an exploded view of the docking connector of the electrical connector assembly of FIG. 1.
Figure 8:
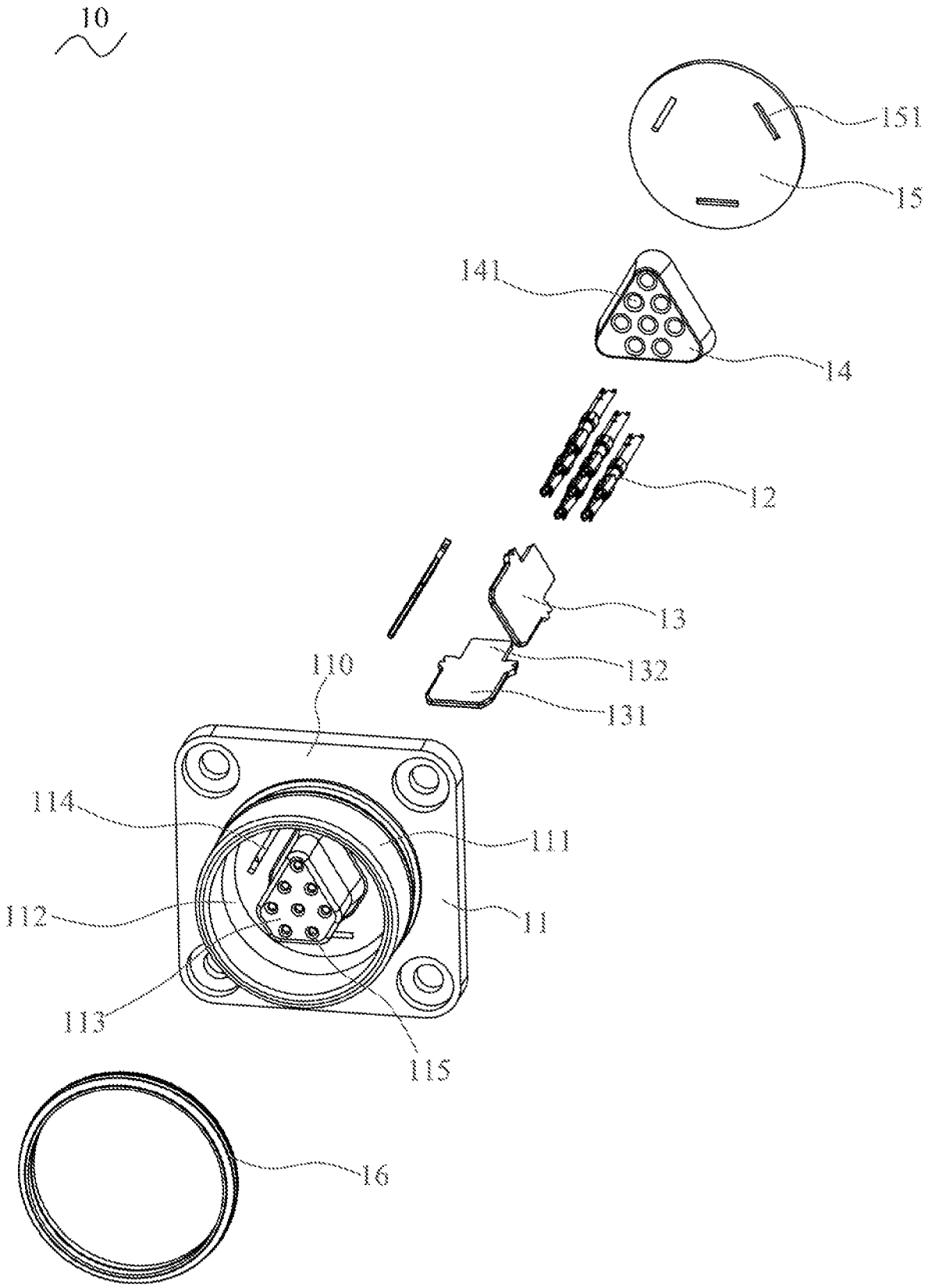
FIG. 8 is another exploded view of the docking connector of the electrical connector assembly of FIG. 1.
Figure 9:
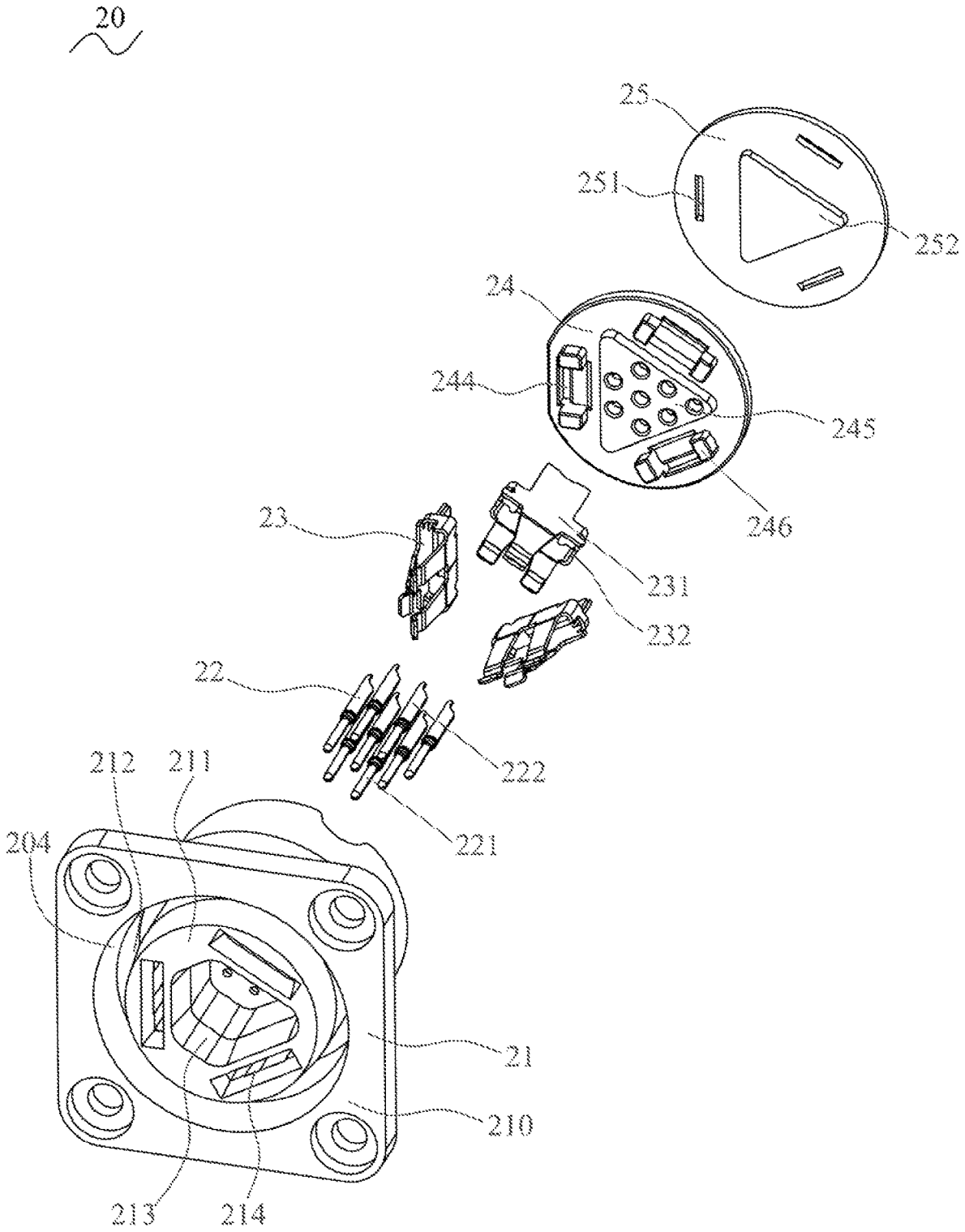
FIG. 9 is an exploded view of the electrical connector of the electrical connector assembly of FIG. 1.
Figure 10:
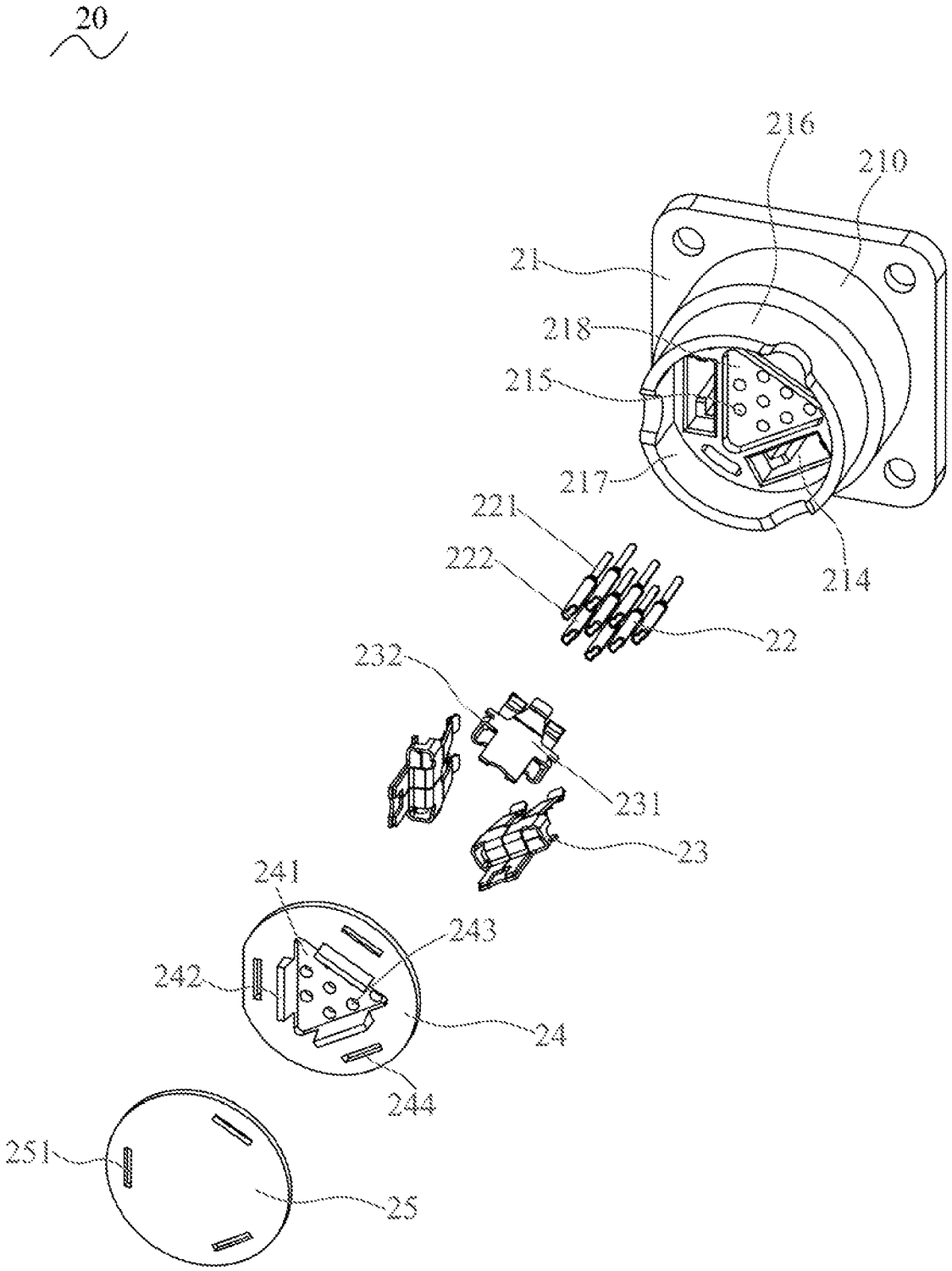
FIG. 10 is another exploded view of the electrical connector of the electrical connector assembly of FIG. 1.
Figure 11:
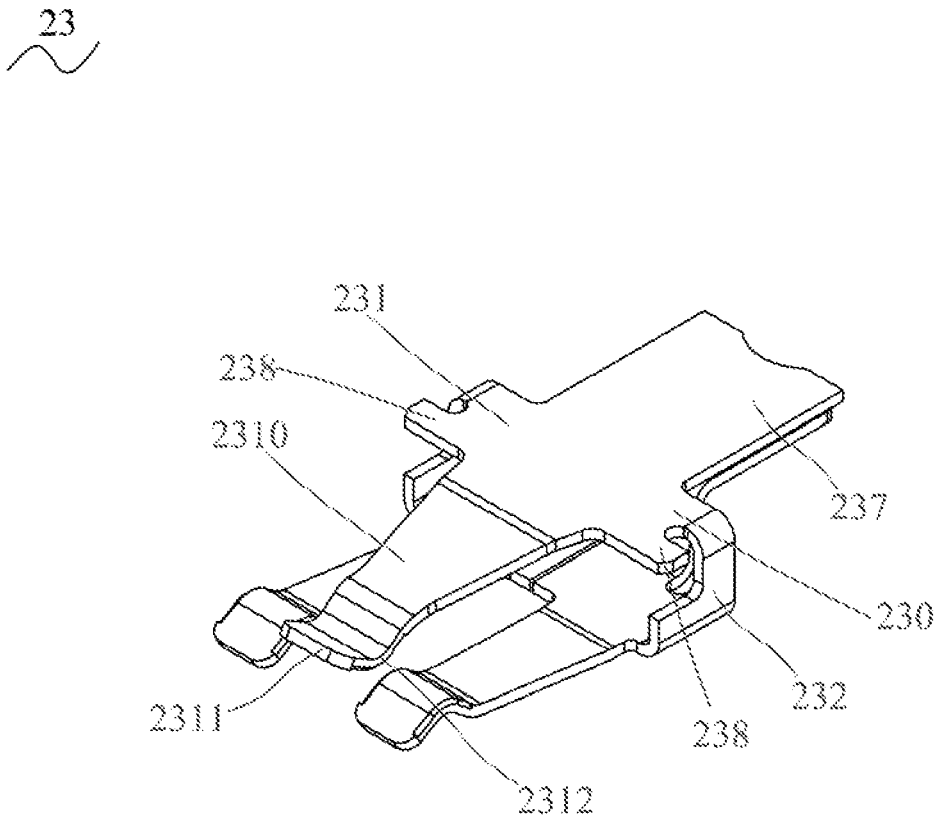
FIG. 11 is a perspective view of a power terminal of the electrical connector of the electrical connector assembly in accordance with a first preferred embodiment of the present invention.
Figure 12:
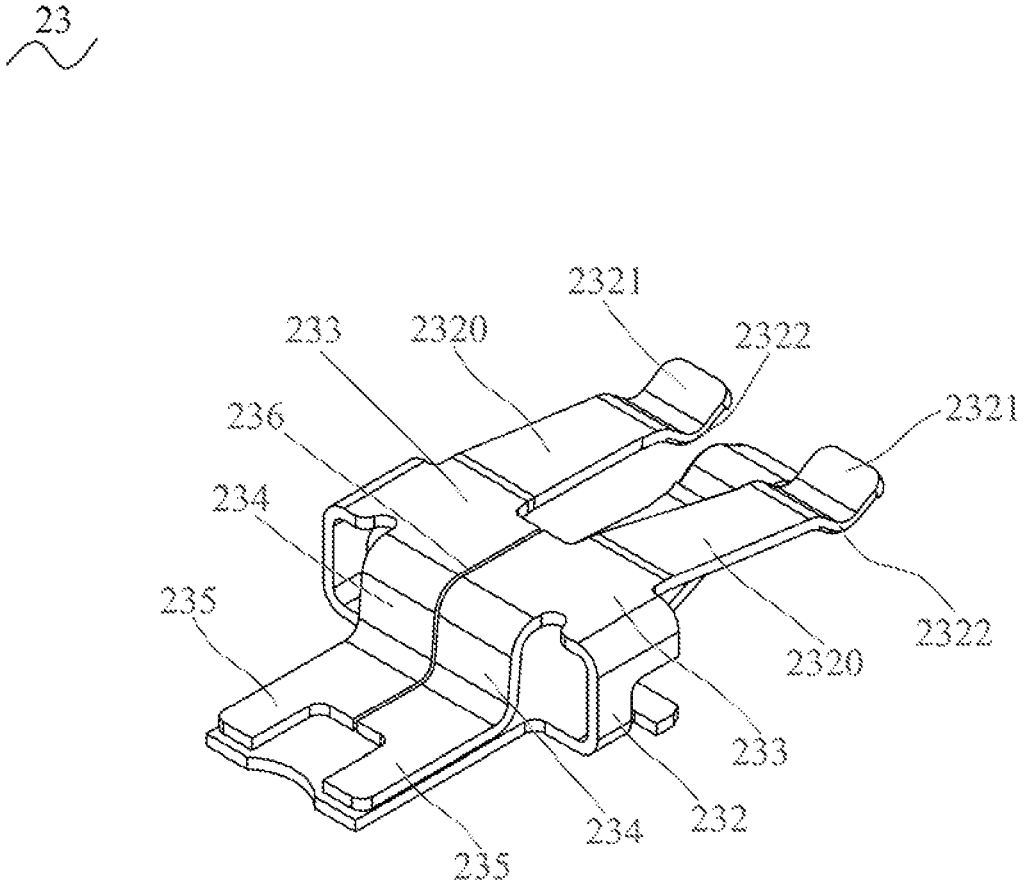
FIG. 12 is another perspective view of the power terminal of the electrical connector of the electrical connector assembly in accordance with the first preferred embodiment of the present invention.
Figure 13:
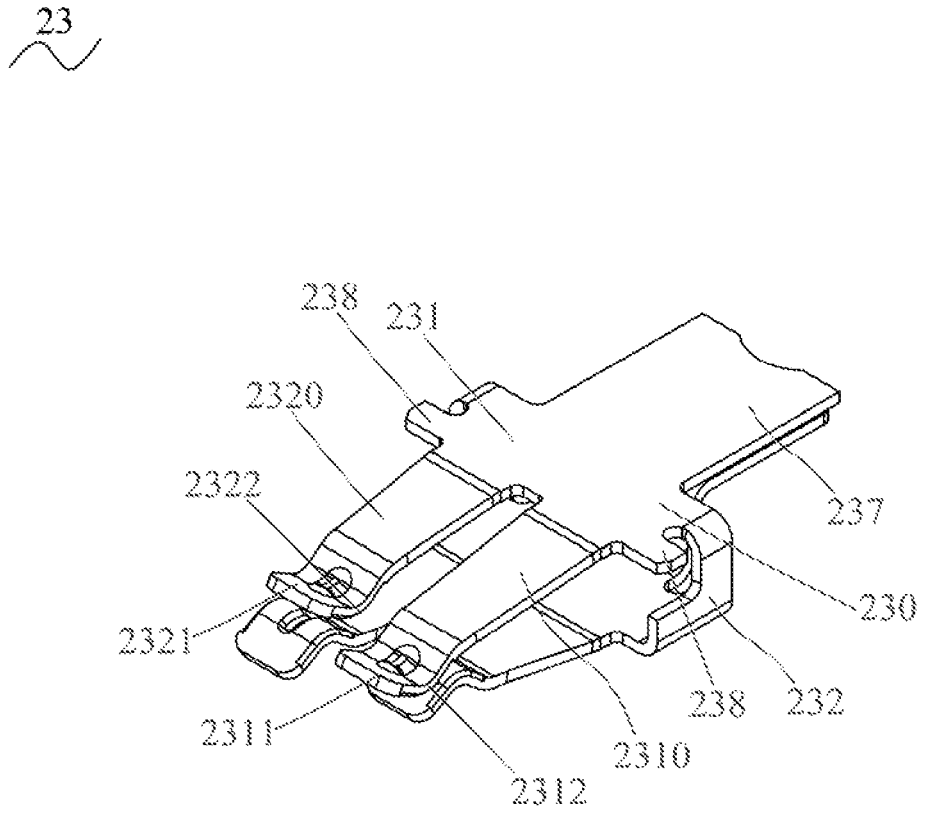
FIG. 13 is a perspective view of the power terminal of the electrical connector of the electrical connector assembly in accordance with a second preferred embodiment of the present invention.
Figure 14:
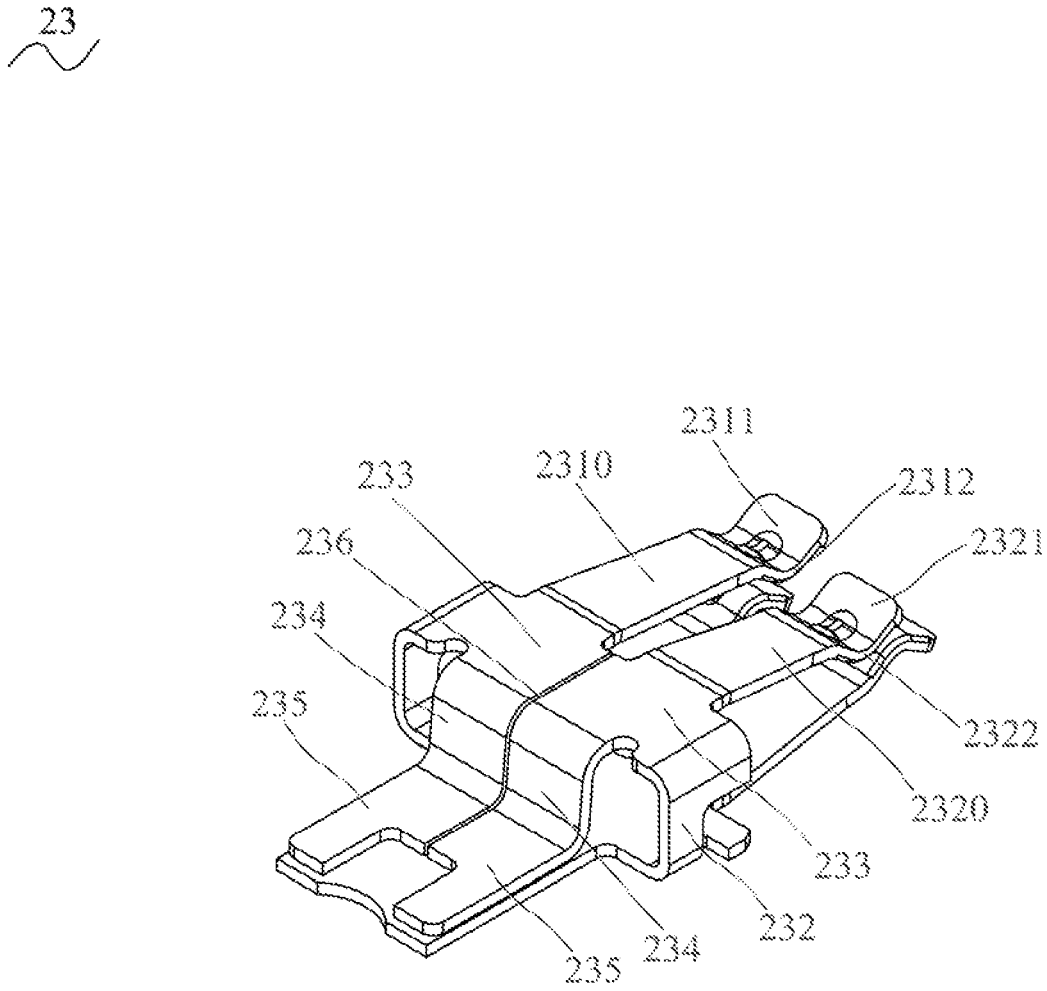
FIG. 14 is another perspective view of the power terminal of the electrical connector of the electrical connector assembly in accordance with the second preferred embodiment of the present invention.
Figure 15:
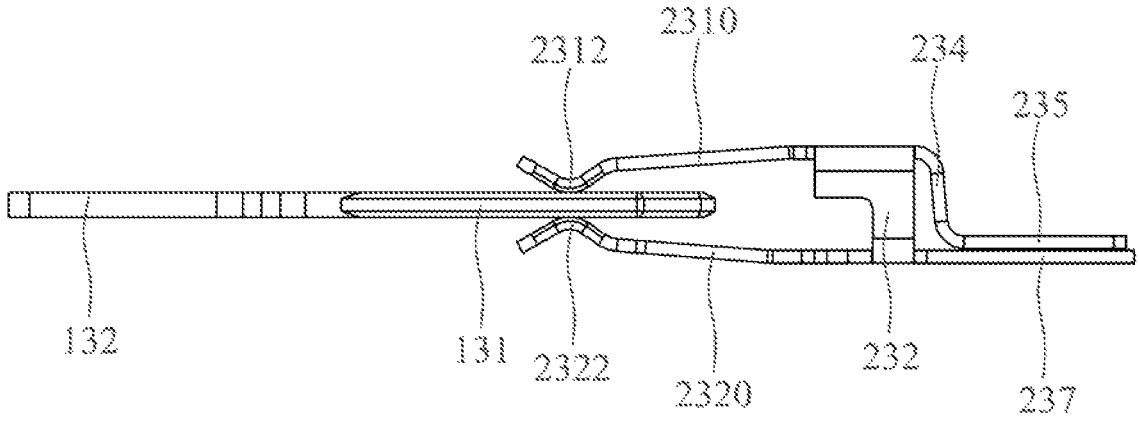
FIG. 15 is a diagrammatic drawing showing that the power terminal of the electrical connector is docked with a docking terminal of the docking connector of the electrical connector assembly in accordance with the first preferred embodiment of the present invention.

With reference to FIG. 1 to FIG. 3, an electrical connector 20 in accordance with a first preferred embodiment and a second preferred embodiment of the present invention is shown. The electrical connector 20 is adapted for being docked with a docking connector 10. The docking connector 10 and the electrical connector 20 are docked with each other to form an electrical connector assembly 100.

With reference to FIG. 3 to FIG. 8, the docking connector 10 includes an insulating housing 11, a plurality of conductive terminals 12, a plurality of docking terminals 13, a back lid 14, a glue body 15 and a sealing ring 16. The plurality of the conductive terminals 12, the plurality of the docking terminals 13, the back lid 14 and the glue body 15 are mounted in the insulating housing 11. The sealing ring 16 is disposed around the insulating housing 11. The plurality of the conductive terminals 12 are disposed among the plurality of the docking terminals 13. The plurality of the docking terminals 13 surround the plurality of the conductive terminals 12. Each docking terminal 13 has a shielding function for isolating an external signal interference to prevent each conductive terminal 12 from being interfered. The back lid 14 is used for fastening the plurality of the conductive terminals 12. The glue body 15 has a waterproof function.

With reference to FIG. 1 to FIG. 3, when the docking connector 10 is docked with the electrical connector 20, the sealing ring 16 is located between the docking connector 10 and the electrical connector 20. The sealing ring 16 is used for preventing water from flowing into the docking connector 10 or the electrical connector 20. Preferably, the docking connector 10 includes eight conductive terminals 12 and three docking terminals 13. The three docking terminals 13 are used for transmitting a power signal and a ground signal.

Referring to FIG. 1 to FIG. 8, the insulating housing 11 has a main body 110, a docking portion 111, a fastening groove 112, a protrusion 113, a plurality of docking terminal grooves 114, a plurality of conductive terminal grooves 115, a surrounding wall 116, a fixing groove 117, a sunken surface 118 and a plurality of blocking walls 119. The main body 110 is shown as a substantially square shape from a front view of the main body 110. The main body 110 has a first docking surface 101, and a second docking surface 102 opposite to the first docking surface 101. The main body 110 has a front surface defined as the first docking surface 101, and a rear surface defined as the second docking surface 102. The docking portion 111 is shown as a hollow cylinder shape. A middle of the first docking surface 101 of the main body 110 extends frontward and toward the electrical connector 20 to form the docking portion 111. The sealing ring 16 is mounted around a rear end of an outer surface of the docking portion 111. A middle of the hollow docking portion 111 is recessed towards the main body 110 to form the fastening groove 112. The hollow docking portion 111 and the main body 110 surround the fastening groove 112 between the docking portion 111 and the first docking surface 101 of the main body 110. The fastening groove 112 is corresponding to a corresponding mechanism of the electrical connector 20.

The middle of the first docking surface 101 of the main body 110 extends frontward and towards the electrical connector 20 to form the protrusion 113. The protrusion 113 is shown as a substantially triangle shape from a front view of the protrusion 113. The docking portion 111 surrounds and is spaced from the protrusion 113. The protrusion 113 is disposed in the fastening groove 112. The protrusion 113 is used for being docked with the corresponding mechanism of the electrical connector 20, so positions of the docking connector 10 and the electrical connector 20 are aligned easily at the time of the docking connector 10 being docked with the electrical connector 20 to protect the plurality of the conductive terminals 12 to make the plurality of the conductive terminals 12 be uneasily damaged.

The plurality of the docking terminal grooves 114 penetrate through the first docking surface 101 and the second docking surface 102 of the main body 110. The plurality of the docking terminal grooves 114 are disposed in the docking portion 111. Front ends of the plurality of the docking terminal grooves 114 are communicated with the fastening groove 112. The protrusion 113 is disposed among the plurality of the docking terminal grooves 114. The plurality of the docking terminals 13 are corresponding to the plurality of the docking terminal grooves 114. A quantity of the plurality of the docking terminals 13 and a quantity of the plurality of the docking terminal grooves 114 are the same. The plurality of the docking terminals 13 are disposed to and penetrate through the plurality of the docking terminal grooves 114. A front end of each docking terminal 13 is exposed in the fastening groove 112 of the docking portion 111.

Preferably, the main body 110 has three docking terminal grooves 114 averagely distributed in the main body 110. The insulating housing 11 has the plurality of the conductive terminal grooves 115 penetrating through a front surface of the protrusion 113 and the second docking surface 102 of the main body 110. Front ends of the plurality of the conductive terminals 12 are disposed in the plurality of the conductive terminal grooves 115 and are surrounded by the protrusion 113. Rear ends of the plurality of the conductive terminals 12 penetrate rearward through the plurality of the conductive terminal grooves 115 and are exposed beyond the second docking surface 102 of the main body 110.

Referring to FIG. 1 to FIG. 8 again, a middle of the second docking surface 102 of the main body 110 extends rearward to form the surrounding wall 116. The surrounding wall 116 is hollow and is shown as an annular shape. The back lid 14 and the glue body 15 are disposed inside the surrounding wall 116. The surrounding wall 116 is used for conveniently dispensing glue to each of the plurality of the conductive terminals 12 and the docking terminals 13 and protecting the plurality of the conductive terminals 12 and the docking terminals 13. An inside of the surrounding wall 116 has the fixing groove 117 recessed towards the main body 110. The insulating housing 11 has the fixing groove 117 formed between an inner surface of the surrounding wall 116 and the second docking surface 102 of the main body 110. The middle of the second docking surface 102 of the main body 110 is recessed inward to form the sunken surface 118 opposite to the docking portion 111. The sunken surface 118 is shown as a trilateral shape seen from a rear view. The sunken surface 118 is disposed inside the surrounding wall 116, and the sunken surface 118 is surrounded by the surrounding wall 116 and the main body 110. The sunken surface 118 is corresponding to the protrusion 113. The sunken surface 118 is formed to an inner surface of a front wall of the fixing groove 117. The back lid 14 is substantially matched with the sunken surface 118, and the back lid 14 is fastened on the sunken surface 118, so the back lid 14 is fastened in the insulating housing 11. The plurality of the conductive terminal grooves 115 penetrate through the sunken surface 118.

Several portions of the middle of the second docking surface 102 of the main body 110 extend rearward to form the plurality of the blocking walls 119. The plurality of the blocking walls 119 are disposed inside the surrounding wall 116, and the plurality of the blocking walls 119 are disposed in the fixing groove 117. The sunken surface 118 is disposed among the plurality of the blocking walls 119. The plurality of the blocking walls 119 are surrounded by the plurality of the docking terminals 13, and the plurality of the conductive terminals 12 are surrounded by the plurality of the blocking walls 119. The plurality of the blocking walls 119 are disposed between the plurality of the conductive terminals 12 and the plurality of the docking terminals 13. The plurality of the blocking walls 119 are corresponding to and are adjacent to the plurality of the docking terminals 13. A quantity of the plurality of the blocking walls 119 is the same as the quantity of the plurality of the docking terminals 13. Outer surfaces of the plurality of the blocking walls 119 are disposed adjacent to inner surfaces of the plurality of the docking terminals 13. Each blocking wall 119 is used for reducing a wire overlap soldering and increasing a creepage distance. The plurality of the blocking walls 119 are disposed adjacent to rear ends of the plurality of the docking terminals 13.

Referring to FIG. 5 to FIG. 8, the plurality of the conductive terminals 12 are assembled to the insulating housing 11. Each conductive terminal 12 has a contact section 121 and a soldering section 122. Each conductive terminal 12 is shown as a circular tube shape. A front end and a rear end of each conductive terminal 12 are opened freely. The contact section 121 of each conductive terminal 12 is a clamping structure. The front end of each conductive terminal 12 is exposed to a front end of the insulating housing 11, and the rear end of each conductive terminal 12 is exposed to a rear end of the insulating housing 11.

The front end of each conductive terminal 12 extends towards the insulating body 21 of the electrical connector 20 to form the contact section 121. The front end of each conductive terminal 12 is disposed in the protrusion 113. The contact section 121 of each conductive terminal 12 is corresponding to a corresponding structure of the electrical connector 20. The rear end of each conductive terminal 12 extends towards the inside of the surrounding wall 116 to form the soldering section 122. The soldering section 122 of each conductive terminal 12 penetrates through the sunken surface 118 and the second docking surface 102 of the insulating housing 11. The soldering section 122 of each conductive terminal 12 is used for being soldered with a wire. Preferably, the soldering section 122 of each conductive terminal 12 is partially exposed out of an outer surface of the glue body 15. The soldering section 122 of each conductive terminal 12 is exposed beyond a rear surface of the glue body 15.

The plurality of the docking terminals 13 are assembled to the insulating housing 11. Preferably, each docking terminal 13 is shown as a flat plate shape and is disposed vertically. Each docking terminal 13 has a contact segment 131 and a soldering segment 132. A front end of each docking terminal 13 is exposed to the front end of the insulating housing 11, and a rear end of each docking terminal 13 is exposed to the rear end of the insulating housing 11. The front end of each docking terminal 13 extends towards the insulating body 21 of the electrical connector 20 to form the contact segment 131. The contact segment 131 of each docking terminal 13 is exposed to the fastening groove 112 of the insulating housing 11. The contact segment 131 of each docking terminal 13 is corresponding to a corresponding part of the electrical connector 20. The rear end of each docking terminal 13 extends towards the inside of the surrounding wall 116 to form the soldering segment 132. The soldering segment 132 of each docking terminal 13 penetrates through the second docking surface 102 of the insulating housing 11. The soldering segment 132 of each docking terminal 13 is used for being soldered with the wire.

Preferably, widths of the plurality of the contact segments 131 of the plurality of the docking terminals 13 are wider than widths of the plurality of the soldering segments 132 of the plurality of the docking terminals 13. The soldering segment 132 of each docking terminal 13 is partially exposed out of the outer surface of the glue body 15. The soldering segment 132 of each docking terminal 13 is exposed beyond the rear surface of the glue body 15. Preferably, the plurality of the docking terminals 13 are neither parallel to nor perpendicular to one another. Extension directions of the plurality of the docking terminals 13 in the insulating housing 11 are multiple directions and are arranged along a direction of a periphery of a polygon. The plurality of the docking terminals 13 are disposed in the insulating housing 11 along different angles with respect to a horizontal plane. The extension directions of the plurality of the docking terminals 13 are different, and an angle is formed between each two docking terminals 13.

The back lid 14 is disposed on the sunken surface 118 of the insulating housing 11. The back lid 14 is used for fastening the plurality of the conductive terminals 12. The back lid 14 has a plurality of apertures 141 penetrating through a front surface and a rear surface of the back lid 14. The plurality of the apertures 141 are corresponding to the plurality of the conductive terminal grooves 115 and the plurality of the conductive terminals 12. A quantity of the plurality of the apertures 141, a quantity of the plurality of the conductive terminal grooves 115 and a quantity of the plurality of the conductive terminals 12 are the same. The soldering sections 122 of the plurality of the conductive terminals 12 penetrate through the plurality of the apertures 141 and are partially exposed out of the outer surface of the glue body 15. Preferably, the back lid 14 has eight apertures 141.

The glue body 15 is disposed inside the surrounding wall 116 of the insulating housing 11 and is covered to the back lid 14. The glue body 15 fills up isolation gaps 103 among the plurality of the conductive terminals 12, the plurality of the docking terminals 13 and the plurality of the blocking walls 119 of insulating housing 11. The glue body 15 is used for providing the waterproof function of the docking connector 10. The glue body 15 has a plurality of penetrating grooves 151 penetrating through a front surface and a rear surface of the glue body 15. The plurality of the penetrating grooves 151 are averagely distributed in the glue body 15. The plurality of the penetrating grooves 151 are corresponding to the plurality of the docking terminal grooves 114 and the plurality of the docking terminals 13. A quantity of the plurality of the penetrating grooves 151, the quantity of the plurality of the docking terminal grooves 114 and the quantity of the plurality of the docking terminals 13 are the same. The soldering segments 132 of the plurality of the docking terminals 13 penetrate through the plurality of the penetrating grooves 151. Preferably, the glue body 15 has three penetrating grooves 151 averagely distributed the glue body 15. The soldering sections 122 of the plurality of the conductive terminals 12, the soldering segments 132 of the plurality of the docking terminals 13 and the plurality of the blocking walls 119 are partially exposed out of the outer surface of the glue body 15.

Referring to FIG. 3 to FIG. 10, the electrical connector 20 is docked with the docking connector 10. The electrical connector 20 includes an insulating body 21, a plurality of signal terminals 22, a plurality of power terminals 23, a back cover 24 and a glue element 25. The plurality of the signal terminals 22, the plurality of the power terminals 23, the back cover 24 and the glue element 25 are disposed in the insulating body 21. A front end and a rear end of the insulating body 21 are opened freely. The plurality of the power terminals 23 surround and are spaced from the plurality of the signal terminals 22. The plurality of the signal terminals 22 are disposed among the plurality of the power terminals 23. Each power terminal 23 has a shielding function for isolating an external signal interference to prevent each signal terminal 22 from being interfered. The back cover 24 is used for fastening the plurality of the signal terminals 22. The glue element 25 has a waterproof function of the electrical connector 20. The plurality of the signal terminals 22 are corresponding to the plurality of the conductive terminals 12. The plurality of the power terminals 23 are corresponding to the plurality of the docking terminals 13. Preferably, the electrical connector 20 includes eight signal terminals 22 and three power terminals 23.

Referring to FIG. 1 to FIG. 10, the insulating body 21 has a base body 210, a bearing portion 211, a receiving groove 212, a docking groove 213, a plurality of power terminal grooves 214, a plurality of signal terminal grooves 215, a periphery wall 216, a locating groove 217 and a concave surface 218. The base body 210 is shown as the substantially square shape from a rear view of the base body 210. The base body 210 has a first connecting surface 201, and a second connecting surface 202 opposite to the first connecting surface 201. The base body 210 has a rear surface defined as the first connecting surface 201, and a front surface defined as the second connecting surface 202. A middle of the first connecting surface 201 of the base body 210 is recessed inward and towards an inside of the base body 210 to form the receiving groove 212. The bearing portion 211 is disposed in the receiving groove 212. A middle of a front wall of the receiving groove 212 protrudes rearward to form the bearing portion 211 disposed in the receiving groove 212 and spaced from an inner surface of an enclosing wall 204 of the receiving groove 212. The fastening groove 112 of the insulating housing 11 is corresponding to the bearing portion 211. The docking portion 111 of the insulating housing 11 is corresponding to the receiving groove 212. A middle of a rear surface of the bearing portion 211 is recessed inward and towards the inside of the base body 210 to form the docking groove 213. The protrusion 113 of the insulating housing 11 is corresponding to and matched with the docking groove 213, so the protrusion 113 is received in the docking groove 213 and the positions of the docking connector 10 and the electrical connector 20 are aligned easily at the time of the docking connector 10 being docked with the electrical connector 20 to protect the plurality of the signal terminals 22 to make the plurality of the signal terminals 22 be uneasily damaged in assembly.

Rear ends of the plurality of the signal terminals 22 are exposed to the docking groove 213. The insulating body 21 has the plurality of the power terminal grooves 214 penetrating through a rear surface of the bearing portion 211 and the second connecting surface 202 of the base body 210. The docking groove 213 is disposed among the plurality of the power terminal grooves 214. The plurality of the power terminals 23 are corresponding to the plurality of the power terminal grooves 214. A quantity of the plurality of the power terminals 23 is the same as a quantity of the plurality of the power terminal grooves 214. The plurality of the power terminals 23 are disposed in the plurality of the power terminal grooves 214. Preferably, the insulating body 21 has three power terminal grooves 214. The three power terminal grooves 214 are averagely distributed in the bearing portion 211. The plurality of signal terminal grooves 215 penetrate through the first connecting surface 201 and the second connecting surface 202 of the base body 210. The plurality of the signal terminal grooves 215 further penetrate through a front wall of the docking groove 213. The plurality of the signal terminals 22 are disposed in the plurality of the signal terminal grooves 215.

A middle of the second connecting surface 202 of the base body 210 protrudes frontward to form the periphery wall 216. The periphery wall 216 is shown as another annular shape. The back cover 24 and the glue element 25 are disposed inside the periphery wall 216. The periphery wall 216 is used for conveniently dispensing the glue to each of the plurality of the signal terminals 22 and the power terminals 23 and protecting the plurality of the signal terminals 22 and the power terminals 23. The periphery wall 216 is hollow. An inside of the periphery wall 216 has the locating groove 217 recessed towards the base body 210 and connected with an outside. The concave surface 218 is formed in an inner surface of a rear wall of the locating groove 217. A middle of the inner surface of the rear wall of the locating groove 217 is recessed inward and towards the base body 210 to form the concave surface 218. The concave surface 218 is disposed inside the periphery wall 216. The concave surface 218 is corresponding to and matched with a corresponding portion of the back cover 24. A middle of a rear of the back cover 24 is matched with the concave surface 218. The middle of the rear of the back cover 24 is mounted on the concave surface 218 of the insulating body 21, and the rest of the back cover 24 is fastened to the rear wall of the locating groove 217, so the back cover 24 is fastened in the periphery wall 216 of the insulating body 21. The plurality of the signal terminal grooves 215 further penetrate through the concave surface 218.

Referring to FIG. 6 to FIG. 10, the plurality of the signal terminals 22 are assembled to the insulating body 21. Each signal terminal 22 is shown as a column shape. Each signal terminal 22 has a contact portion 221 and a soldering portion 222. The plurality of the conductive terminals 12 are corresponding to the plurality of the signal terminals 22. A front end of each signal terminal 22 is exposed to a front end of the insulating body 21, and a rear end of each signal terminal 22 is exposed to a rear end of the insulating body 21. The rear end of each signal terminal 22 has the contact portion 221 extending towards the insulating housing 11 and exposed to the docking groove 213. The contact portions 221 of the plurality of the signal terminals 22 are corresponding to the contact sections 121 of the plurality of the conductive terminals 12. The front end of each signal terminal 22 has the soldering portion 222 extending opposite to the insulating housing 11 and extending towards the inside of the periphery wall 216. The periphery wall 216 surrounds the soldering portions 222 of the plurality of the signal terminals 22. The soldering portion 222 of each signal terminal 22 is used for being soldered with the wire. The soldering portion 222 of each signal terminal 22 is exposed out of an outer surface of the glue element 25. The soldering portion 222 of each signal terminal 22 is exposed beyond a front surface of the glue element 25.

Referring to FIG. 5, FIG. 6, FIG. 11, FIG. 12 and FIG. 15, the plurality of the power terminals 23 are assembled to and mounted in the insulating body 21. The plurality of the docking terminals 13 are corresponding to the plurality of the power terminals 23. Each power terminal 23 has a base plate 231, at least one bending arm 232, at least one connecting portion 233, at least one bending piece 234, at least one extending portion 235, a slit 236, a tail portion 237, at least one first elastic arm 2310 and at least two second elastic arms 2320. In the first preferred embodiment, each power terminal 23 includes two bending arms 232, two connecting portions 233, two bending pieces 234, two extending portions 235, one first elastic arm 2310 and two second elastic arms 2320. The base plate 231, the two bending arms 232 and the two connecting portions 233 of each power terminal 23 form a base portion 230. The plurality of the power terminals 23 are neither parallel to nor perpendicular to one another. Extension directions of the plurality of the power terminals 23 in the insulating body 21 are multiple directions and are arranged along the direction of the periphery of the polygon. The extension directions of the plurality of the power terminals 23 in the insulating body 21 are different, so the angle is formed between each two power terminals 23 in the insulating body 21.

Each power terminal 23 is shown as another clamping structure and is disposed longitudinally. Two opposite sides of the base plate 231 extend towards the plurality of the signal terminals 22 to form the two bending arms 232 substantially perpendicular to the base plate 231. Two free ends of the two bending arms 232 extend towards each other to form the two connecting portions 233. The two connecting portions 233 are spaced from and are substantially parallel to the base plate 231. In the first preferred embodiment, the base plate 231, the two bending arms 232 and the two connecting portions 233 form a rectangular frame shape structure seen from a longitudinal view. A front end of the base plate 231 of each power terminal 23 extends frontward and towards the inside of the periphery wall 216 to form the tail portion 237. Two front ends of the two connecting portions 233 of each power terminal 23 are bent and extend towards the tail portion 237, and then are bent frontward to form the two bending pieces 234. Front ends of the two bending pieces 234 are bent frontward and extend along an inner surface of the tail portion 237 to form the two abreast extending portions 235. The base plate 231 and the two extending portions 235 are horizontally disposed. The base plate 231 and the tail portion 237 are parallel to the two extending portions 235. The two extending portions 235 are used for being soldered with the wire.

In the first preferred embodiment, the two extending portions 235 of each power terminal 23 are exposed out of the outer surface of the glue element 25. The two connecting portions 233, the two bending pieces 234 and the two extending portions 235 are spaced to form the slit 236 among the two connecting portions 233, the two bending pieces 234 and the two extending portions 235. The slit 236 is used for reserving a tolerance margin. The tail portion 237 is parallel to the two extending portions 235. The tail portion 237 is used for being soldered with the wire. The tail portion 237 of each power terminal 23 is exposed out of the outer surface of the glue element 25. The two opposite sides of the base plate 231 extend oppositely to form two buckling portions 238. The two buckling portions 238 are located adjacent to two inner sides of the two bending arms 232. The two buckling portions 238 are fastened in the insulating body 21.

A middle of a rear end of the base plate 231 slantwise extends inward and towards the docking connector 10 to form the one first elastic arm 2310. Two rear ends of the two connecting portions 233 slantwise extend inward and towards the docking connector 10 to form the two second elastic arms 2320. The one first elastic arm 2310 and the two second elastic arms 2320 are located at a same side of the base portion 230. The two second elastic arms 2320 are symmetrical to each other with respect to middle portions of the two connecting portions 233. The one first elastic arm 2310 and the two second elastic arms 2320 are extended rearward from and are disposed to a rear end of the base portion 230. The one first elastic arm 2310 slantwise extends towards the two second elastic arms 2320 slightly. The one first elastic arm 2310 is disposed corresponding to an interval between the two second elastic arms 2320.

A positive force of the one first elastic arm 2310 is equal to a sum of positive forces of the two second elastic arms 2320 to ensure that the plurality of the docking terminals 13 inserted into the plurality of the power terminals 23 is non-deformed. A rear end of the one first elastic arm 2310 extends towards the docking connector 10 and then is arched inward and towards the interval between the two second elastic arms 2320 to form a first bending portion 2311. An inner portion of the first bending portion 2311 is defined as a first protruding portion 2312. The first protruding portions 2312 of the plurality of the power terminals 23 contact with the contact segments 131 of the plurality of the docking terminals 13. Two rear ends of the two second elastic arms 2320 extend towards the docking connector 10 and then are arched inward and approach to two sides of the one first elastic arm 2310 to form two second bending portions 2321. An inner portion of each second bending portion 2321 has a second protruding portion 2322. The second protruding portions 2322 of the plurality of the power terminals 23 contact with the contact segments 131 of the plurality of the docking terminals 13.

Referring to FIG. 3, FIG. 11, FIG. 12 and FIG. 15, when each power terminal 23 is seen from a side view, the first protruding portion 2312 and the two second protruding portions 2322 of each power terminal 23 are aligned. The first protruding portions 2312 and the second protruding portions 2322 of the plurality of the power terminals 23 are aligned along a vertical plane. When the plurality of the power terminals 23 are combined with the plurality of the docking terminals 13, the first protruding portion 2312 of the one first elastic arm 2310 of each power terminal 23 contacts with one surface of the contact segment 131 of one docking terminal 13. The two second elastic arms 2320 of each power terminal 23 contacts with the other surface of the contact segment 131 of the one docking terminal 13 opposite to the one surface of the contact segment 131 of the one docking terminal 13. The first protruding portion 2312 of the one first elastic arm 2310 and the two second protruding portions 2322 of the two second elastic arms 2320 are arched in opposite directions and along a vertical direction.

Referring to FIG. 1 to FIG. 10, the back cover 24 is disposed in the locating groove 217. The back cover 24 is disposed to a position of the concave surface 218 of the insulating body 21. The back cover 24 is used for fastening the plurality of the signal terminals 22. The back cover 24 has a concave portion 241, a plurality of supporting walls 242, a plurality of perforations 243, a plurality of first insertion holes 244, a first protruding block 245 and a plurality of fastening portions 246. A middle of an outer surface of the back cover 24 is recessed rearward and towards an inside of the insulating body 21 to form the concave portion 241. Several portions of the middle of the outer surface of the back cover 24 extend outward to form the plurality of the supporting walls 242. The concave portion 241 is disposed among the plurality of the supporting walls 242. The plurality of the supporting walls 242 are averagely distributed around the middle of the outer surface of the back cover 24. Preferably, the back cover 24 has three supporting walls 242 averagely distributed on the back cover 24 and around the middle of the outer surface of the back cover 24. Each supporting wall 242 is used for reducing the wire overlap soldering and increasing the creepage distance. A front surface of the back cover 24 is defined as the outer surface of the back cover 24.

The plurality of the perforations 243 penetrate through the front surface and a rear surface of the back cover 24. The soldering portion 222 of each signal terminal 22 penetrates through one perforation 243 and is exposed out of the outer surface of the glue element 25. The plurality of the first insertion holes 244 penetrate through the front surface and the rear surface of the back cover 24. Positions of the plurality of the first insertion holes 244 are corresponding to positions of the plurality of the supporting walls 242. The plurality of the first insertion holes 244 are disposed to and are spaced from outsides of the plurality of the supporting walls 242. The plurality of the first insertion holes 244 surround the concave portion 241, the plurality of the perforations 243 and the plurality of the supporting walls 242. The plurality of the supporting walls 242 are disposed between the plurality of the first insertion holes 244 and the plurality of the perforations 243. The plurality of the perforations 243 are formed in the concave portion 241. A quantity of the plurality of the second perforations 243, a quantity of the plurality of the signal terminal grooves 215 and a quantity of the plurality of the signal terminals 22 are the same. Preferably, the back cover 24 has eight perforations 243. The back cover 24 has three first insertion holes 244 averagely distributed in the back cover 24.

A middle of the rear surface of the back cover 24 extends towards the concave surface 218 of the insulating body 21 to form the first protruding block 245. The first protruding block 245 is fastened on the concave surface 218 of the insulating body 21, so the back cover 24 is fastened in the insulating body 21. Several portions of the rear surface of the back cover 24 extend towards the plurality of the power terminal grooves 214 of the insulating body 21 to form the plurality of the fastening portions 246. Each first insertion hole 244 is located to and adjacent to one fastening portion 246. The plurality of the fastening portions 246 are corresponding to the plurality of the power terminals 23. A quantity of the plurality of the fastening portions 246 is the same as the quantity of the plurality of the power terminal 23. The plurality of the fastening portions 246 are used for fastening positions of the plurality of the power terminals 23. One end of each power terminal 23 penetrates through one first insertion hole 244, and then the one end of each power terminal 23 is buckled with and fastened to the one fastening portion 246. Preferably, the back cover 24 has three fastening portions 246. The plurality of the fastening portions 246 are filled in the plurality of the power terminal grooves 214.

The glue element 25 is disposed in the periphery wall 216 of the insulating body 21 and is covered to the back cover 24. The glue element 25 fills up assembly gaps 203 among the plurality of the signal terminals 22, the plurality of the power terminals 23 and the plurality of the supporting walls 242 of back cover 24. The glue element 25 is used for the waterproof function of the electrical connector 20. The glue element 25 has a plurality of second insertion holes 251 and a second protruding block 252. The plurality of the second insertion holes 251 penetrate through the front surface and a rear surface of the glue element 25. The plurality of the second insertion holes 251 are corresponding to the plurality of the power terminal grooves 214 and the plurality of the power terminals 23. A quantity of the plurality of the second insertion holes 251, the quantity of the plurality of the power terminal grooves 214 and the quantity of the plurality of the power terminals 23 are the same. The plurality of the second insertion holes 251 are averagely distributed in the glue element 25.

Preferably, the glue element 25 has three second insertion holes 251 averagely distributed in the glue element 25. A middle of the rear surface of the glue element 25 extends towards the back cover 24 to form the second protruding block 252. The second protruding block 252 is disposed among the plurality of the second insertion holes 251. The second protruding block 252 is fastened to and buckled to the concave portion 241, so the glue element 25 is fastened to a front of the back cover 24. The soldering portion 222 of each signal terminal 22, the tail portion 237 of each power terminal 23 and each supporting wall 242 are partially exposed out of the outer surface of the glue element 25. The soldering portion 222 of each signal terminal 22, the tail portion 237 of each power terminal 23 and each supporting wall 242 are partially exposed beyond the front surface of the glue element 25. The electrical connector 20 is a vehicle-used electrical connector.

Referring to FIG. 1, FIG. 3, FIG. 6, FIG. 13, FIG. 14 and FIG. 16, the electrical connector 20 and the power terminal 23 of the electrical connector 20 in accordance with the second preferred embodiment of the present invention are shown. Differences between the electrical connector 20 in accordance with the second preferred embodiment and the electrical connector 20 in accordance with the first preferred embodiment are described as follows. In the second preferred embodiment, the power terminal 23 has the base plate 231, the two bending arms 232, the two connecting portions 233, the two bending pieces 234, the two extending portions 235, the slit 236, the tail portion 237, two first elastic arms 2310 and the two second elastic arms 2320.

Two sides of the rear end of the base plate 231 slantwise extend inward and towards the docking connector 10 to form the one first elastic arm 2310 and one second elastic arm 2320 which are abreast arranged. The two rear ends of the two connecting portions 233 slantwise extend inward and towards the docking connector 10 to form the other first elastic arm 2310 and the other second elastic arm 2320. A length of each first elastic arm 2310 is longer than a length of each second elastic arm 2320.

The one first elastic arm 2310 and the one second elastic arm 2320 of the base plate 231 are corresponding and are complementary to the other second elastic arm 2320 and the other first elastic arm 2310 of the two connecting portions 233, so that an insertion force of the plurality of the docking terminals 13 being inserted into the plurality of the power terminals 23 is reduced to prevent the plurality of the docking terminals 13 and the plurality of the power terminals 23 from being deformed at the time of the plurality of the docking terminals 13 being inserted into the plurality of the power terminals 23. The one first elastic arm 2310 and the one second elastic arm 2320 of the base plate 231 slantwise extend towards the other second elastic arm 2320 and the other first elastic arm 2310 of the two connecting portions 233 from fronts of the plurality of the power terminals 23 to rears of the plurality of the power terminals 23 gradually, and the other first elastic arm 2310 and the other second elastic arm 2320 of the two connecting portions 233 slantwise extend toward the one second elastic arm 2320 and the one first elastic arm 2310 of the base plate 231 from the fronts of the plurality of the power terminals 23 to the rears of the plurality of the power terminals 23 gradually.

A rear end of each first elastic arm 2310 extends towards the docking connector 10 and then is arched inward and towards one of the two second elastic arms 2320 to form the first bending portion 2311. The inner portion of the first bending portion 2311 is defined as the first protruding portion 2312. The first protruding portions 2312 of the plurality of the power terminals 23 are used for contacting with the contact segments 131 of the plurality of the docking terminals 13 of the docking connector 10. The two rear ends of the two second elastic arms 2320 extend towards the docking connector 10 and then are arched inward and towards the rear ends of the two first elastic arms 2310 to form two second bending portions 2321. The inner portion of each second bending portion 2321 has the second protruding portions 2322. The second protruding portions 2322 of the plurality of the power terminals 23 are used for contacting with the contact segments 131 of the plurality of the docking terminals 13 of the docking connector 10. The first protruding portions 2312 of the plurality of the power terminals 23 and the second protruding portions 2322 of the plurality of the power terminals 23 are unaligned. The first protruding portions 2312 of the plurality of the power terminals 23 are aligned, and the second protruding portions 2322 of the plurality of the power terminals 23 are aligned. The first protruding portions 2312 of the plurality of the power terminals 23 are aligned along another vertical plane, and rear ends of the second protruding portions 2322 of the plurality of the power terminals 23 are aligned along one more vertical plane. The first protruding portion 2312 of the first elastic arm 2310 of the base plate 231 is in alignment with the first protruding portion 2312 of the first elastic arm 2310 of one connecting portion 233. The second protruding portion 2322 of the second elastic arm 2320 of the base plate 231 is in alignment with the second protruding portion 2322 of the second elastic arm 2320 of the other connecting portion 233.

The two first elastic arms 2310 of each power terminal 23 are disposed longitudinally. The two first elastic arms 2310 of each power terminal 23 are mounted to two opposite surfaces of the contact segment 131 of the one docking terminal 13. The two first protruding portions 2312 of the two first elastic arms 2310 of each power terminal 23 contact with the two opposite surfaces of the contact segment 131 of the one docking terminal 13. The two first protruding portions 2312 of the two first elastic arms 2310 of each power terminal 23 are arched in two opposite directions along the vertical direction and are abreast arranged. The two second elastic arms 2320 are disposed longitudinally. The two second elastic arms 2320 of each power terminal 23 are mounted to the two opposite surfaces of the contact segment 131 of the one docking terminal 13. The two second protruding portions 2322 of the two second elastic arms 2320 of each power terminal 23 are arched in the two opposite directions along the vertical direction and are abreast arranged. The two second protruding portions 2322 of the two second elastic arms 2320 of each power terminal 23 contact with the two opposite surfaces of the contact segment 131 of the one docking terminal 13.

Figure 16:
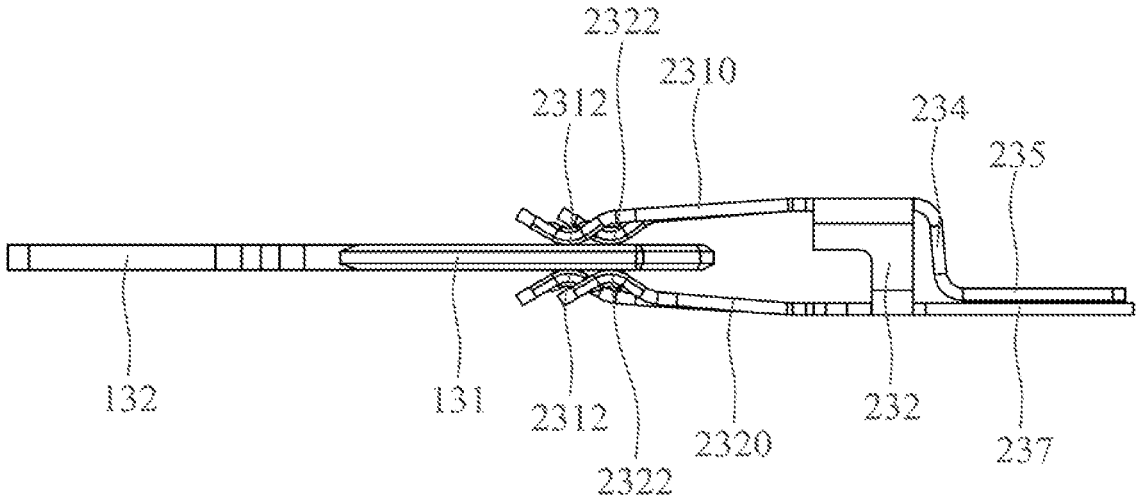
FIG. 16 is a diagrammatic drawing showing that the power terminal of the electrical connector is docked with the docking terminal of the docking connector of the electrical connector assembly in accordance with the second preferred embodiment of the present invention.

Referring to FIG. 1 to FIG. 16, in the second preferred embodiment, a slope of the first elastic arm 2310 of each power terminal 23 is smaller than a slope of the second elastic arm 2320 of each power terminal 23. After the plurality of the power terminals 23 are combined with the plurality of the docking terminals 13, and the plurality of the power terminals 23 are seen from side views, the first protruding portion 2312 of the first elastic arm 2310 of the rear end of the base plate 231 and the second protruding portion 2322 of the second elastic arm 2320 of the rear end of the base plate 231 are respectively disposed on and contact the same one surface of the contact segment 131 of the one docking terminal 13, and the second protruding portion 2322 of the second elastic arm 2320 of the base plate 231 is in front of a rear end of the first protruding portion 2312 of the first elastic arm 2310 of the base plate 231. The second protruding portion 2322 of the second elastic arm 2320 of the base plate 231 is in front of a tip end of the first protruding portion 2312 of the first elastic arm 2310 of the base plate 231. That the first protruding portion 2312 of the first elastic arm 2310 of the base plate 231 and the second protruding portion 2322 of the second elastic arm 2320 of the base plate 231 has two different profiles disposed along two different cutting lines are shown in FIG. 16.

The first elastic arm 2310 of one connecting portion 233 is longer than the second elastic arms 2320 of the other connecting portion 233 and the rear end of the base plate 231 along a longitudinal direction, and the first elastic arm 2310 of the base plate 231 is longer than the second elastic arms 2320 of the rear end of the base plate 231 and the other connecting portion 233 along the longitudinal direction. A slope of the first elastic arm 2310 of each of the one connecting portion 233 and the rear end of the base plate 231 is smaller than a slope of the second elastic arm 2320 of each of the other connecting portion 233 and the rear end of the base plate 231.

After the plurality of the power terminals 23 are combined with the plurality of the docking terminals 13, and the plurality of the power terminals 23 are seen from the side views, the first protruding portion 2312 of the first elastic arm 2310 and the second protruding portion 2322 of the second elastic arm 2320 of the two rear ends of the two connecting portions 233 are disposed on and contact the other surface of the contact segment 131 of the one docking terminal 13 opposite to the one surface of the contact segment 131 of the one docking terminal 13, and the second protruding portion 2322 of the second elastic arm 2320 of the other connecting portion 233 is in front of a rear end of the first protruding portion 2312 of the first elastic arm 2310 of the one connecting portion 233. The second protruding portion 2322 of the second elastic arm 2320 of the other connecting portion 233 is in front of a tip end of the first protruding portion 2312 of the first elastic arm 2310 of the one connecting portion 233. Thus, the first elastic arm 2310 and the second elastic arm 2320 of the rear end of the base plate 231 are corresponding to the second elastic arm 2320 and the first elastic arm 2310 of the two rear ends of the two connecting portions 233. That the first protruding portion 2312 of the first elastic arm 2310 and the second protruding portion 2322 of the second elastic arm 2320 of the two rear ends of the two connecting portions 233 has the two different profiles disposed along the two different cutting lines are shown in FIG. 16.

After the plurality of the power terminals 23 are combined with the plurality of the docking terminals 13, and the plurality of the power terminals 23 are seen from the side views, the first protruding portion 2312 of the first elastic arm 2310 of the rear end of the base plate 231 and the first protruding portion 2312 of the first elastic arm 2310 of the rear end of the one connecting portion 233 are mounted to and contact the two opposite surfaces of the contact segment 131 of the one docking terminal 13, and the two first protruding portions 2312 of the base plate 231 and the one connecting portion 233 are arched in the two opposite directions and along the vertical direction. That the profiles and cutting line positions of the first protruding portion 2312 of the first elastic arm 2310 of the rear end of the base plate 231 and the first protruding portion 2312 of the first elastic arm 2310 of the rear end of the one connecting portion 233 are disposed to be the same are shown in FIG. 16. The second protruding portion 2322 of the second elastic arm 2320 of the rear end of the base plate 231 and the second protruding portion 2322 of the second elastic arm 2320 of the rear end of the other connecting portion 233 are respectively mounted to and contact the two opposite surfaces of the contact segment 131 of the one docking terminal 13, and the two second protruding portions 2322 of the base plate 231 and the one connecting portion 233 are arched in the two opposite directions and along the vertical direction. That the profiles and cutting line positions of the second protruding portion 2322 of the second elastic arm 2320 of the rear end of the base plate 231 and the second protruding portion 2322 of the second elastic arm 2320 of the rear end of the other connecting portion 233 are disposed to be the same are shown in FIG. 16. The cutting lines of the two first protruding portions 2312 and the two second protruding portions 2322 of each power terminal 23 are disposed along the longitudinal direction and along an insertion direction between the plurality of the power terminals 23 and the docking terminals 13. Each of the plurality of the conductive terminals 12, the signal terminals 22, the docking terminals 13 and the power terminals 23 is integrally formed. An aligned plane of the two first protruding portions 2312 and an aligned plane of the two second protruding portions 2322 of each power terminal 23 are disposed along a front-to-rear direction and along the insertion direction between the plurality of the power terminals 23 of the electrical connector 20 and the docking terminals 13 of the docking connector 10.

As described above, each power terminal 23 has the shielding function for isolating the external signal interference to prevent each signal terminal 22 from being interfered. When the docking connector 10 is docked with the electrical connector 20, the plurality of the conductive terminals 12 are corresponding to the plurality of the signal terminals 22, the plurality of the docking terminals 13 are corresponding to the plurality of the power terminals 23. The first elastic arms 2310 and the second elastic arms 2320 of the connecting portions 233 of the plurality of the power terminals 23 are corresponding and complementary to the first elastic arms 2310 and the second elastic arms 2320 of the base plates 231 of the plurality of the power terminals 23, so that the insertion force of the plurality of the docking terminals 13 being inserted into the plurality of the power terminals 23 is reduced to prevent the plurality of the docking terminals 13 and the plurality of the power terminals 23 from being deformed at the time of the plurality of the docking terminals 13 being inserted into the plurality of the power terminals 23. As a result, the electrical connector 20 including the plurality of the power terminals 23 and the signal terminals 22 has a lower manufacture cost and increases a current transmission stability to have the better current transmission stability.

What is claimed is:

1. An electrical connector adapted for being docked with a docking connector, comprising:

an insulating body;

a plurality of signal terminals assembled to the insulating body; and a plurality of power terminals mounted in the insulating body, the plurality of the power terminals surrounding and being spaced from the plurality of the signal terminals, each power terminal having a base plate, two first elastic arms and two second elastic arms, two opposite sides of the base plate extending towards the plurality of the signal terminals to form two bending arms, two free ends of the two bending arms extending towards each other to form two connecting portions, two sides of a rear end of the base plate slantwise extending inward and towards the docking connector to form one first elastic arm and one second elastic arm, two rear ends of the two connecting portions slantwise extending inward and towards the docking connector to form the other first elastic arm and the other second elastic arm, the one first elastic arm and the one second elastic arm of the base plate slantwise extending towards the other second elastic arm and the other first elastic arm of the two connecting portions, and the other first elastic arm and the other second elastic arm of the two connecting portions slantwise extending towards the one second elastic arm and the one first elastic arm of the base plate from fronts of the plurality of the power terminals to rears of the plurality of the power terminals gradually;

wherein a length of each first elastic arm is longer than a length of each second elastic arm.

2. An electrical connector adapted for being docked with a docking connector, comprising:

an insulating body;

a plurality of signal terminals assembled to the insulating body; and a plurality of power terminals mounted in the insulating body, the plurality of the power terminals surrounding and being spaced from the plurality of the signal terminals, each power terminal having a base plate, two first elastic arms and two second elastic arms, two opposite sides of the base plate extending towards the plurality of the signal terminals to form two bending arms, two free ends of the two bending arms extending towards each other to form two connecting portions, two sides of a rear end of the base plate slantwise extending inward and towards the docking connector to form one first elastic arm and one second elastic arm, two rear ends of the two connecting portions slantwise extending inward and towards the docking connector to form the other first elastic arm and the other second elastic arm, the one first elastic arm and the one second elastic arm of the base plate being corresponding to and being complementary to the other second elastic arm and the other first elastic arm of the two connecting portions, the one first elastic arm and the one second elastic arm of the base plate slantwise extending towards the other second elastic arm and the other first elastic arm of the two connecting portions, and the other first elastic arm and the other second elastic arm of the two connecting portions slantwise extending towards the one second elastic arm and the one first elastic arm of the base plate from fronts of the plurality of the power terminals to rears of the plurality of the power terminals gradually.

3. The electrical connector as claimed in claim 2, wherein a length of each first elastic arm is longer than a length of each second elastic arm.

4. The electrical connector as claimed in claim 2, wherein a slope of the first elastic arm of each power terminal is smaller than a slope of the second elastic arm of each power terminal.

5. The electrical connector as claimed in claim 2, wherein a rear end of each first elastic arm extends towards the docking connector and then is arched inward and towards one of the two second elastic arms to form a first bending portion, an inner portion of the first bending portion is defined as a first protruding portion, the first protruding portions of the plurality of the power terminals are used for contacting with a plurality of docking terminals of the docking connector, two rear ends of the two second elastic arms extend towards the docking connector and then are arched inward and towards the rear ends of the two first elastic arms to form two second bending portions, an inner portion of each second bending portion has a second protruding portion, the second protruding portions of the plurality of the power terminals are used for contacting with the plurality of the docking terminals of the docking connector, the first protruding portions of the plurality of the power terminals and the second protruding portions of the plurality of the power terminals are unaligned, the two first protruding portions of the two first elastic arms of each power terminal are arched in two opposite directions along a vertical direction, the two second protruding portions of the two second elastic arms of each power terminal are arched in the two opposite directions along the vertical direction.

6. The electrical connector as claimed in claim 5, wherein the first protruding portion of the first elastic arm of the base plate is in alignment with the first protruding portion of the first elastic arm of one connecting portion.

7. The electrical connector as claimed in claim 6, wherein the second protruding portion of the second elastic arm of the base plate is in alignment with the second protruding portion of the second elastic arm of the other connecting portion, an aligned plane of the two first protruding portions and an aligned plane of the two second protruding portions of each power terminal are disposed along a front-to-rear direction and along an insertion direction between the plurality of the power terminals and the docking terminals of the docking connector.

8. An electrical connector adapted for being docked with a docking connector, comprising:

an insulating body;

a plurality of signal terminals assembled to the insulating body; and a plurality of power terminals assembled to the insulating body, the plurality of the power terminals surrounding and being spaced from the plurality of the signal terminals, each power terminal having a base plate, two opposite sides of the base plate extending towards the plurality of the signal terminals to form two bending arms, two free ends of the two bending arms extending towards each other to form two connecting portions, a middle of a rear end of the base plate slantwise extending inward and towards the docking connector to form one first elastic arm, two rear ends of the two connecting portions slantwise extending inward and towards the docking connector to form two second elastic arms, the one first elastic arm slantwise extending towards the two second elastic arms slightly, the one first elastic arm being disposed corresponding to an interval between the two second elastic arms, a rear end of the one first elastic arm extending towards the docking connector and then being arched inward and towards the interval between the two second elastic arms to form a first bending portion, an inner portion of the first bending portion being defined as a first protruding portion, two rear ends of the two second elastic arms extending towards the docking connector and then being arched inward and approaching to two sides of the one first elastic arm to form two second bending portions, an inner portion of each second bending portion having a second protruding portion, the first protruding portion of the one first elastic arm and the two second protruding portions of the two second elastic arms being arched in opposite directions and along a vertical direction, the first protruding portions and the second protruding portions of the plurality of the power terminals being aligned along a vertical plane.

9. The electrical connector as claimed in claim 8, wherein the base plate, the two bending arms and the two connecting portions of each power terminal form a base portion, the one first elastic arm and the two second elastic arms are located at a same side of the base portion, the two second elastic arms are symmetrical to each other with respect to middle portions of the two connecting portions, the one first elastic arm and the two second elastic arms are extended rearward from and are disposed to a rear end of the base portion.

10. The electrical connector as claimed in claim 8, wherein a front end of the base plate of each power terminal extends frontward to form a tail portion, two front ends of the two connecting portions of each power terminal are bent and extend towards the base plate, and then are bent frontward to form two bending pieces, front ends of the two bending pieces are bent frontward and extend along an inner surface of the tail portion to form two abreast extending portions, the tail portion is parallel to the two extending portions, the two connecting portions, the two bending pieces and the two extending portions are spaced to form a slit among the two connecting portions, the two bending pieces and the two extending portions.

11. The electrical connector as claimed in claim 8, wherein the two opposite sides of the base plate extend oppositely to form two buckling portions, the two buckling portions are located adjacent to two inner sides of the two bending arms.

12. The electrical connector as claimed in claim 8, wherein a positive force of the one first elastic arm is equal to a sum of positive forces of the two second elastic arms.

13. The electrical connector as claimed in claim 8, wherein the insulating body has a base body, the base body has a first connecting surface, and a second connecting surface opposite to the first connecting surface, a middle of the first connecting surface of the base body is recessed inward and towards an inside of the base body to form a receiving groove, a middle of a front wall of the receiving groove protrudes rearward to form a bearing portion disposed in the receiving groove, the docking connector includes an insulating housing, the insulating housing has a main body, a middle of a first docking surface of the main body extends frontward and towards the electrical connector to form a protrusion, a rear of the bearing portion is recessed towards the inside of the base body to form a docking groove, the protrusion is received in the docking groove.

14. The electrical connector as claimed in claim 13, wherein the insulating body has a plurality of power terminal grooves penetrating through a rear surface of the bearing portion and the second connecting surface of the base body, the docking groove is disposed among the plurality of the power terminal groove, the plurality of the power terminals are disposed in the plurality of the power terminal grooves.

15. The electrical connector as claimed in claim 13, wherein the second connecting surface of the base body protrudes frontward to form a periphery wall, an inside of the periphery wall has a locating groove recessed towards the base body, a middle of an inner surface of a rear wall of the locating groove is recessed inward and towards the base body to form a concave surface, the concave surface is disposed inside the periphery wall.

16. The electrical connector as claimed in claim 15, wherein each signal terminal has a contact portion and a soldering portion, a rear end of each signal terminal has the contact portion extending towards the insulating housing and exposed to the docking groove, a front end of each signal terminal has the soldering portion extending opposite to the insulating housing and extending towards the inside of the periphery wall.

17. The electrical connector as claimed in claim 15, further comprising a back cover mounted on the concave surface of insulating body, an outer surface of the back cover being recessed rearward and towards the inside of the insulating body to form a concave portion, several portions of a middle of the outer surface of the back cover extending outward to form a plurality of supporting walls, the concave portion being disposed among the plurality of the supporting walls, the plurality of the supporting walls being averagely distributed around the middle of the outer surface of the back cover.

18. The electrical connector as claimed in claim 17, wherein the back cover has a plurality of perforations penetrating through a front surface and a rear surface of the back cover, the back cover has a plurality of first insertion holes penetrating through the front surface and the rear surface of the back cover, several portions of the middle of the outer surface of the back cover extend outward to form a plurality of supporting walls, the plurality of the first insertion holes are disposed to and are spaced from outsides of the plurality of the supporting walls, positions of the plurality of the first insertion holes are corresponding to positions of the plurality of the supporting walls, the plurality of the supporting walls are disposed between the plurality of the first insertion holes and the plurality of the perforations, the plurality of the perforations are formed in the concave portion.

19. The electrical connector as claimed in claim 18, wherein the rear surface of the back cover extends towards the concave surface of the insulating body to form a first protruding block, the first protruding block is fastened on the concave surface of the insulating body, several portions of the rear surface of the back cover extend towards the insulating body to form a plurality of the fastening portions corresponding to the plurality of the power terminals, a quantity of the plurality of the fastening portions is the same as a quantity of the plurality of the power terminals.

20. The electrical connector as claimed in claim 19, further comprising a glue element disposed in the periphery wall of the insulating body and covered to the back cover, the glue element having a plurality of second insertion holes and a second protruding block, the plurality of second insertion holes penetrate through a front surface and a rear surface of the glue element, the plurality of the second insertion holes are averagely distributed in the glue element, the rear surface of the glue element extends towards the back cover to form the second protruding block, the second protruding block is disposed among the plurality of the second insertion holes, the second protruding block is buckled to the concave portion.

* * * * *